US007308852B2

(12) United States Patent
Kaminaka et al.

(10) Patent No.: US 7,308,852 B2
(45) Date of Patent: Dec. 18, 2007

(54) HEATING COOKING DEVICE

(75) Inventors: Ikuyasu Kaminaka, Osaka (JP); Tadashi Nasu, Osaka (JP); Masayuki Iwamoto, Osaka (JP); Yuzi Andoh, Nara (JP); Takashi Hashimoto, Osaka (JP); Toshiyuki Irie, Nara (JP); Tetsuichi Arita, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/499,188

(22) PCT Filed: Dec. 24, 2002

(86) PCT No.: PCT/JP02/13460

§ 371 (c)(1),
(2), (4) Date: Oct. 18, 2004

(87) PCT Pub. No.: WO03/058125

PCT Pub. Date: Jul. 17, 2003

(65) Prior Publication Data

US 2005/0039613 A1 Feb. 24, 2005

(30) Foreign Application Priority Data

Dec. 28, 2001 (JP) ..... 2001-400835
Dec. 28, 2001 (JP) ..... 2001-400877
Apr. 9, 2002 (JP) ..... 2002-107003

(51) Int. Cl.
*A47J 37/00* (2006.01)

(52) U.S. Cl. ..... 99/476; 99/330; 219/702; 219/757

(58) Field of Classification Search ..... 99/330, 99/337–340, 342, 467–473, 474–476, 417, 99/516; 126/20, 299 R, 21 A, 21 R; 219/400, 219/401, 385, 396, 393, 492, 757, 707, 698–702, 219/720; 426/523, 509–511; 392/492, 360, 392/399, 400, 394, 393
See application file for complete search history.

(56) References Cited

U.S. PATENT DOCUMENTS 3,823,760 A * 7/1974 Bloomfield et al. ..... 164/113

(Continued)

FOREIGN PATENT DOCUMENTS

CN 1257571 A 6/2000

(Continued)

OTHER PUBLICATIONS

International Search Report for corresponding PCT/JP02/13460, mailed Dec. 24, 2002.

(Continued)

*Primary Examiner*—Timothy F. Simone
(74) *Attorney, Agent, or Firm*—Renner, Otto, Boisselle & Sklar, LLP

(57) ABSTRACT

A cooking oven, wherein air in a cooking chamber is sucked into a blower on the outside of the cooking chamber and fed to an upper duct and a lateral duct, air current led into the upper duct is heated by an upper heater and re-circulated from an upper blowing port to the cooking chamber, a catalyst block heated by a catalyst heating heater is disposed in the upper duct to decompose lamp black and smell substances contained in the air current, catalyst paint is applied onto the inner wall surface of the upper duct to reinforce a performance for decomposing the lamp black and smell substances, both the lateral duct and the upper duct are formed in the same structure, the distributions of heating volumes of the upper heater and the lateral heater in the cross sections of the upper duct and the lateral duct are set so that larger heating volumes are generated on larger air volume sides according to the air volume distributions in the cross sections of the ducts, and the catalyst block is also disposed in the cross sections of the ducts eccentrically to the larger heater heating volume side.

19 Claims, 22 Drawing Sheets

U.S. PATENT DOCUMENTS

| | | | | | |
|---|---|---|---|---|---|
| 3,889,099 | A | * | 6/1975 | Nuss | 219/393 |
| 4,110,916 | A | * | 9/1978 | Bemrose | 34/197 |
| 4,244,979 | A | * | 1/1981 | Roderick | 426/418 |
| 4,503,760 | A | * | 3/1985 | Pryputsch et al. | 99/447 |
| 4,823,766 | A | * | 4/1989 | Violi | 126/20 |
| 4,824,644 | A | * | 4/1989 | Cox et al. | 422/300 |
| 5,029,519 | A | * | 7/1991 | Boyen | 99/341 |
| 5,160,829 | A | * | 11/1992 | Chang | 219/400 |
| 5,272,963 | A | * | 12/1993 | Del Fabbro | 99/468 |
| 5,423,248 | A | * | 6/1995 | Smith et al. | 99/443 C |
| 5,481,962 | A | * | 1/1996 | Tedesco | 99/323.4 |
| 6,070,517 | A | * | 6/2000 | Helm | 99/330 |

FOREIGN PATENT DOCUMENTS

| | | |
|---|---|---|
| JP | 57-155039 | 9/1982 |
| JP | 58-104803 | 7/1983 |
| JP | 62-141115 | 9/1987 |
| JP | 62-268921 | 11/1987 |
| JP | 3-199822 | 8/1991 |
| JP | 4-169716 | 6/1992 |
| JP | 5-90204 | 12/1993 |
| JP | 6-323553 | 11/1994 |
| JP | 7-42946 | 2/1995 |
| JP | 7-151333 | 6/1995 |
| JP | 8-66460 | 3/1996 |
| JP | 10-202112 | 8/1998 |
| JP | 2000-220858 | 8/2000 |
| JP | 2000-510568 | 8/2000 |
| JP | 2001-321291 | 10/2001 |
| WO | 98/54517 | 12/1998 |

OTHER PUBLICATIONS

Chinese Office Action for corresponding Application No. 02826283.2, mailed May 19, 2006.

* cited by examiner

HEATING COOKING DEVICE

TECHNICAL FIELD OF THE INVENTION

The present invention relates to a cooking oven that cooks foods with heat by application of a hot air stream thereto.

DESCRIPTION OF RELATED ART

Cooking ovens such as convention ovens and hot-air-impingement ovens that cook foods with heat by forming a circulated current of hot air stream inside a cooking chamber in which foods are placed, are well known and widely used. Published documents such as, to name a few, Japanese Utility Model Published No. H6-23841 and Japanese Patent Applications Laid-Open Nos. H9-145063, Hi1-166737, 2000-329351, and 2001-311518 disclose examples of hot-air-circulation cooking ovens. On the other hand, Japanese Patent Published No. H9-503334 discloses an example of a hot-air-impingement cooking oven. Among these examples, the cooking oven disclosed in Japanese Patent Application Laid-Open No. 2001-311518 has a heater arranged inside a duct through which a air stream is sent to a cooking chamber.

Now, as the basis of the present invention, the construction of a hot-air-circulation cooking oven will be described with reference to FIGS. 33 and 34. FIG. 33 is a front view of the cooking oven, and FIG. 34 is a vertical sectional view thereof.

The cooking oven 1 has a cabinet in the shape of a rectangular parallelepiped. Inside the cabinet 10, there is formed a cooking chamber 11 in the shape of a rectangular parallelepiped. The top and bottom of the cooking chamber 11 are formed by a ceiling wall 12 and a floor wall 13, respectively. Of the four sides of the cooking chamber 11, three are formed by a rear inner wall 14, a left inner wall 15, and a right inner wall 16, respectively, and the fourth side is formed by a freely openable door 17. The door 17 and all the walls of the cooking chamber 11 are heat-insulated.

The cooking chamber 11, which is enclosed from six sides by the walls and the door as described above, has the following interior dimensions: 230 mm high, 408 mm wide, and 345 mm deep. It should be understood that all the values given as dimensions, speeds, temperatures, and the like in the present specification are merely preferable examples and are not meant to limit the scope of the present invention in any way.

Outside the rear inner wall 14, there is installed a blower 20. The blower 20 has a centrifugal fan 22 arranged inside a fan casing 21. This centrifugal fan 22 is rotated in the forward and backward directions by a reversible-rotation motor, which will be described later. The fan casing 21 is of a type that branches into two directions, and has an upper discharge port 23 and a side discharge port 24. The upper discharge port 23 connects to an upper duct 25 provided outside the ceiling wall 12. The side discharge port 24 connects to a side duct 26 provided outside the left inner wall 15.

The upper duct 25 has an upper blowout port 30 open to the cooking chamber 11. The side duct 26 has a side blowout port 31 open to the cooking chamber 11. In the rear inner wall 14, there is formed a suction port 32 of the blower 20. The upper blowout port 30 is formed by a group of small cylindrical holes each 11 mm across. The side blowout port 31 and the suction port 32 are each formed by a group of small holes each 5 mm across.

As shown in FIG. 34, in the upper duct 25 is provided an upper heater 40. In the side duct 26 is provided a side heater 41. Outside the right inner wall 16, there are arranged a microwave heating device 42 that assists the heating by the upper and side heaters 40 and 41 and a controller 43 that controls the operation of the cooking oven 1 as a whole. On the outer front surface of the right inner wall 16, there is provided an operation panel 44 (see FIG. 33) that accepts instructions for the controller 43.

On the floor wall 13, there is arranged a turntable 50 on which to place foods. On the turntable 50 is placed a supporting means such as a grill or rack that suits the kind of food placed. Reference number 51 represents a turntable drive motor.

The cooking oven 1 operates as follows. First, the door 17 is opened. Then, among different types of supporting means such as grills and racks, one that suits the intended kind of food is placed on the turntable 50. On this supporting means, foods are placed directly or using a container. Then, the door 17 is closed.

After the door 17 is closed, cooking conditions are entered via the operation panel 44. Based on the thus entered cooking conditions, the controller 43 selects the optimum among a plurality of pre-programmed cooking methods. The controller 43 then drives the blower 20, upper heater 40, side heater 41, microwave heating device 42, and turntable drive motor 51 to start cooking.

For example, in a case where roasted chicken is prepared, a grill is placed on the turntable 50, and a chunk of meat is placed on the grill. Then, the door 17 is closed, and then, from the menu displayed on the operation panel 44, "roasted chicken" is selected. Now, the controller 43 operates the blower 20, upper heater 40, side heater 41, microwave heating device 42, and turntable drive motor 51 in a mode for preparing "roasted chicken."

The upper heater 40 has a power rating of 1,700 W, and the side heater 41 has a power rating of 1,200 W. Out from each of the upper blowout port 30 and the side blowout port 31 blows a hot air stream having a temperature of 300° C. or more as measured at those ports. The controller 43 controls the blower 20 in such a way that the air stream blown out from the upper blowout port 30 has a air stream speed of 65 km/h or more, and that the air stream blown out from the side blowout port 31 has a air stream speed of 30 km/h or less. The turntable 50 is rotated at a rotation rate of 6 rpm.

In the case described above, heating cooking is achieved by a hot-air-impact method whereby a high-speed hot air stream is blown onto foods. This permits fast cooking of the chunk of meat. The temperature inside the cooking chamber 11 is automatically adjusted at the target temperature entered via the operation panel 44. The upper limit of the target temperature is 300° C.

Next, how sponge cake is prepared will be described. A rack is placed on the turntable 50. Then, dough to be cooked into sponge cake is placed on the turntable 50 and also on the rack. The door 17 is closed, and, from the menu displayed on the operation panel 44, "sponge cake" is selected. Now, the controller 43 operates the blower 20, upper heater 40, side heater 41, microwave heating device 42, and turntable drive motor 52 in a mode for preparing "sponge cake." Also here, the turntable 50 is rotated at a rotation rate of 6 rpm.

Here, however, the controller 43 controls the blower 20 in such a way that a hot air stream having a air stream speed of 30 km/h or less blows out from the upper blowout port 30, and that a hot air stream having a air stream speed of 40 km/h or less blows out from the side blowout port 31. In this case, heating cooking is achieved by two-stage hot-air-circulation method, and this permits the dough placed on the turntable 50 and on the rack to be each cooked into fluffy sponge cake. The hot air stream that blows from above has a low speed, and thus does not deform by its pressure the dough in the process of rising.

In heating cooking, a hot air stream or a microwave may be used singly, or they may be generated simultaneously so that heating is achieved by their combined effect. Whether to use the effect of a hot air stream or a microwave alone or their combined effect is determined by a cooking program or through selection by the user.

The cooking oven 1 described above can cope with various kinds of food and various methods of cooking by adjusting the ratio of the volumes of air stream blown out by the blower 20, the volumes of air stream themselves, and the air stream speeds, and by adjusting the amounts of heat generated by the upper and side heaters 40 and 41 and the output of the microwave heating device 42.

As cooking is performed on the cooking oven 1 described above, foods release oil, fat, and odor substances. Such oil and fat, in the form of greasy fumes, soil the interior of the cooking chamber and ducts. They also settle on foods and spoil the flavor thereof. Odor substances, when exposed to heat, deteriorate. Such deteriorated odor substances, when they settle on foods, spoil the flavor thereof.

To overcome these inconveniences, proposals have conventionally been made to decompose greasy fumes and odor substances with a catalyst. For example, Japanese Patent Application Laid-Open No. H4-62324 discloses a construction wherein a deodorizing catalyst and a catalyst heating means are arranged inside a container in which food is heated. Japanese Patent Application Published No. 2000-510568 discloses a recirculation-type cooking oven provided with a catalyst converter. Japanese Patent Application Laid-Open No. HI0-202112 discloses a cooking oven wherein a catalyst coating is applied on interior paint.

BRIEF SUMMARY OF THE INVENTION

An object of the present invention is to provide a cooking oven that permits a catalyst to function satisfactorily and that can decompose greasy fumes and odor substances with high efficiency.

To achieve the above object, according to the present invention, a cooking oven is constructed as follows. The cooking oven has a blowout port and a suction port for passage of a hot air stream provided inside a cooking chamber and has a blower and a heat source for producing the hot air stream provided outside the cooking chamber so as to produce a circulated hot air stream inside the cooking chamber so that foods are cooked with heat by the circulated air stream. In this cooking oven, a catalyst block for decomposing substances released from foods and a heat source for heating the catalyst block are arranged inside the duct through which the hot air stream is fed to the blowout port. The heat source is so arranged as to face a plurality of faces of the catalyst block. With this construction, the catalyst block receives radiant heat from a plurality of directions, and thus quickly reaches the temperature that permits the catalyst to function. This permits the catalyst to start to function at an early stage. Moreover, of the plurality of faces of the catalyst block, one is made to face in the direction from which the circulated air stream blows. Thus, the circulated air stream heated by the heat source flows through the catalyst block. The catalyst block is heated from both inside and outside, and thus quickly reaches the temperature that permits the catalyst to function. In addition, of the plurality of faces of the catalyst block, another, i.e., one other than that facing in the direction from which the circulated air stream blows, is a face opposite thereto. Thus, not only the face that the circulated air stream blows directly onto but also the face opposite thereto is heated. This permits the catalyst to function satisfactorily irrespective of whether it is located on the upstream or downstream side of the air stream.

According to the present invention, a cooking oven is constructed as follows. The catalyst block is held by a fitting member in such a way as not to make contact with an interior wall surface of the duct. With this construction, the catalyst block does not make contact with an interior wall surface of the duct, and thus the heat of the catalyst block does not conduct to the walls of the duct.

According to the present invention, a cooking oven is constructed as follows. The cooking oven has a blowout port and a suction port for passage of a hot air stream provided inside a cooking chamber and has a blower and a heat source for producing the hot air stream provided outside the cooking chamber so as to produce a circulated hot air stream inside the cooking chamber so that foods are cooked with heat by the circulated air stream. In this cooking oven, catalyst paint for decomposing substances released from foods is applied to at least part of an interior wall surface of the duct through which the hot air stream is fed to the blowout port. With this construction, while the hot air stream is passing through the duct, substances released from foods are decomposed by the catalyst paint. Thus, even in a case where there is only a limited area for the arrangement of the catalyst, it is possible to exploit an interior wall surface of the duct to secure a sufficient contact-area between the catalyst and air stream.

According to the present invention, a cooking oven is constructed as follows. The cooking oven has a blowout port and a suction port for passage of a hot air stream provided inside a cooking chamber and has a blower and a heat source for producing the hot air stream provided outside the cooking chamber so as to produce a circulated hot air stream inside the cooking chamber so that foods are cooked with heat by the circulated air stream. In this cooking oven, a catalyst block for decomposing substances released from foods and a heat source for heating the catalyst block are arranged inside the duct through which the hot air stream is fed to the blowout port. The catalyst block is fitted at a distance from an interior wall surface of the duct. Moreover, catalyst paint for decomposing substances released from foods is applied to at least part of an interior wall surface of the duct. With this construction, the catalyst paint complements the function of the catalyst block, resulting in high-level decomposition.

Arranging the catalyst block in such a way as to completely obstruct the duct results in a high airflow resistance through the duct. This leads to a reduced amount of hot air stream or, if the desired amount of air stream is to be maintained, necessitates a blower with higher performance. This can be avoided by securing a gap between the catalyst block and an interior wall surface of the duct. Even when a gap is secured between the catalyst block and an interior wall surface of the duct to permit an air stream to pass therethrough in this way, unwanted substances contained in that air stream are decomposed by the catalyst paint. This helps obtain high-level decomposition performance.

According to the present invention, the cooking oven constructed as described above is constructed as follows. The surface to which the catalyst paint is applied has surface irregularities. With this construction, it is possible to increase the contact area between the catalyst paint surface and the air stream and thereby obtain still higher decomposition performance.

According to the present invention, the cooking oven constructed as described above is constructed as follows. Wave-shaped surface irregularities are formed on the interior wall surface of the duct. Of the slanted surfaces forming the surface irregularities, those facing in the direction from which the air stream blows are long and those facing in the direction opposite thereto are short. With this construction, it is possible to achieve efficient contact between the air stream and the catalyst paint surface and thereby obtain even higher decomposition performance.

According to the present invention, the cooking oven constructed as described above is constructed as follows. The surface irregularities are formed as ridges or grooves aligned along the air stream. With this construction, it is possible to increase the contact area between the catalyst paint surface and the air stream without diminishing the flow speed of the air stream. This makes it possible to obtain high-level decomposition performance even when the amount of hot air stream is large.

According to the present invention, the cooking oven constructed as described above is constructed as follows. The catalyst paint is applied to a air-stream-regulating plate provided inside the duct for regulating the air stream flowing toward the blowout port. With this construction, the air stream surely makes contact with the catalyst paint, permitting the catalyst to function satisfactorily.

According to the present invention, a cooking oven is constructed as follows. The cooking oven has a blowout port and a suction port for passage of a hot air stream provided in a wall of a cooking chamber and has a blower and a duct provided outside the cooking chamber, the blower sucking in air through the suction port and the duct directing the air blown out from the blower to the blowout port and heating the air with a heater incorporated therein, so as to produce a circulated hot air stream inside the cooking chamber so that foods are cooked with heat by the circulated air stream. In this cooking oven, a catalyst block for decomposing substances released from the foods is arranged inside the duct, and the distribution of the amount of heat generated by the heater within a cross section of the duct is so set as to be commensurate with the distribution of the amount of air stream within that cross section so that an increasingly large amount of heat is generated as there is an increasingly large amount of air stream. With this construction, the catalyst block is quickly heated by the hot air stream that flows through the duct, and thus the catalyst starts to function satisfactorily at an early stage. Moreover, the air flowing through that part of the cross section of the duct where the amount of air stream is large is given a commensurately large amount of heat. This helps achieve appropriate distribution of the amount of air stream and the amount of heat generated, resulting in efficient heating of air.

According to the present invention, the cooking oven constructed as described above is constructed as follows. The duct has a bent portion at a midpoint thereof. The heater is arranged at or on the downstream side of the bent portion, and the distribution of the amount of heat generated by the heater is so set that an increasingly large amount of heat is generated from the inner side to the outer side of the bent portion. With this construction, the large amount of air stream that flows at the outer side of the bent portion of the duct is given a commensurately large amount of heat. This helps achieve, in the duct having the bent portion, appropriate distribution of the amount of air stream and the amount of heat generated, resulting in efficient heating of air.

According to the present invention, the cooking oven constructed as described above is constructed as follows. The catalyst block is so arranged as to lie lopsided toward the side of a cross section of the duct where the amount of heat generated by the heater is larger. With this construction, the catalyst block is heated quickly, and is kept at a high temperature. This permits the catalyst to function fully.

According to the present invention, the cooking oven constructed as described above is constructed as follows. The catalyst block is fitted to an interior wall of the duct at the side thereof where the amount of heat generated by the heater is larger. With this construction, through heat conduction by way of the walls of the duct in addition to through direct heat radiation, the catalyst block is heated efficiently.

DETAILED DESCRIPTION OF THE INVENTION

Figure 33:
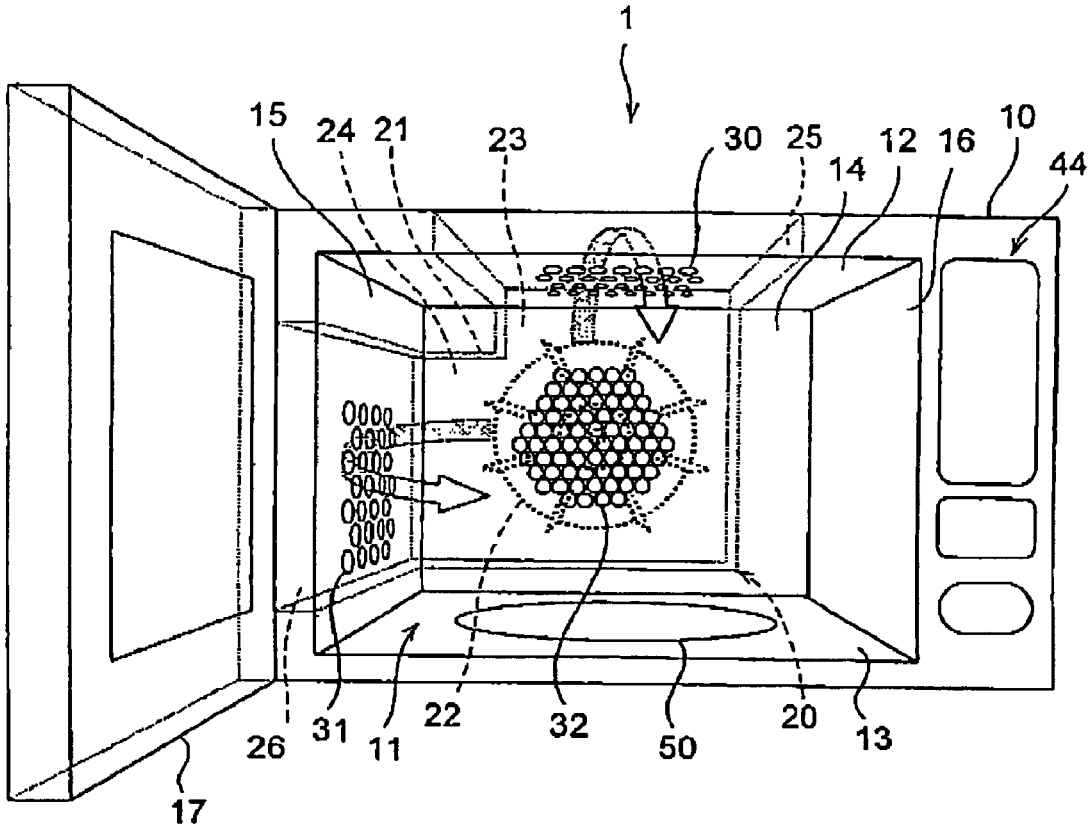
FIG.33 RELATED ART
FIG. 33 is a front view of a conventional cooking oven, showing it in perspective.
Figure 34:
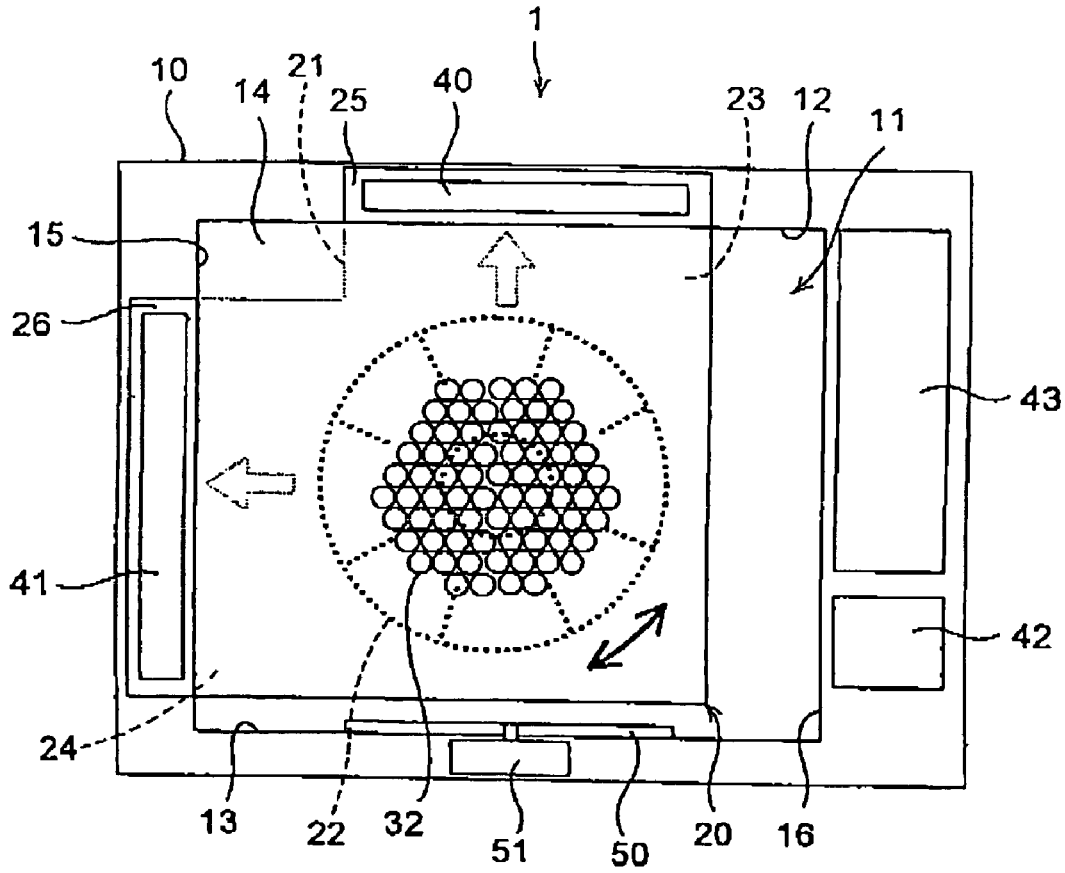
FIG.34 RELATED ART
FIG. 34 is a vertical sectional view of the above conventional cooking oven.

Hereinafter, a first embodiment of a cooking oven according to the invention will be described with reference to FIGS. 1 to 6. The cooking oven 1 of the first embodiment is constructed in a similar manner to the cooking oven 1 shown in FIGS. 33 and 34, and therefore, here, only such components as are relevant to the invention are illustrated. Of the components of the cooking oven 1, those which are common to the cooking oven 1 are identified with the same reference numbers as used earlier for them, and their explanations will not be repeated. The same principle is applied also to the second and following embodiments; that is, such components as have already been described are identified with the same reference numbers as used earlier for them, and their explanations will not be repeated unless necessary.

Figure 1:
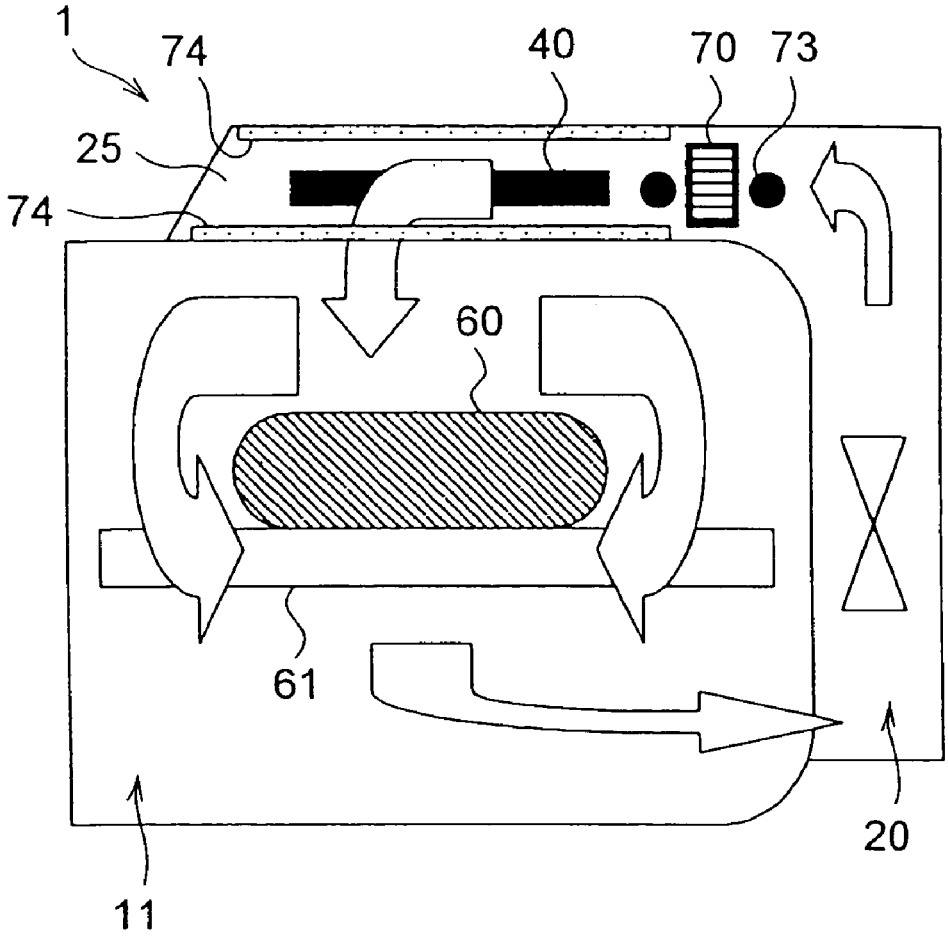
FIG. 1 is a schematic vertical sectional view showing a first embodiment of a cooking oven according to the invention.
Figure 2:
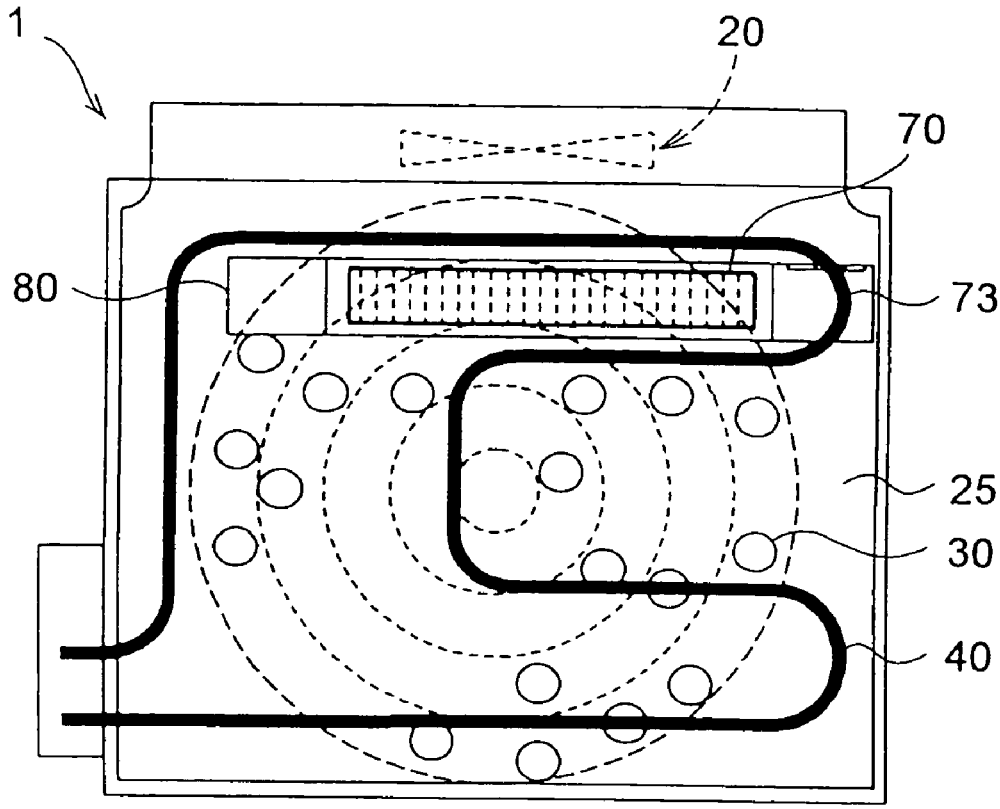
FIG. 2 is a schematic horizontal sectional view of the cooking oven of the first embodiment.
Figure 3:
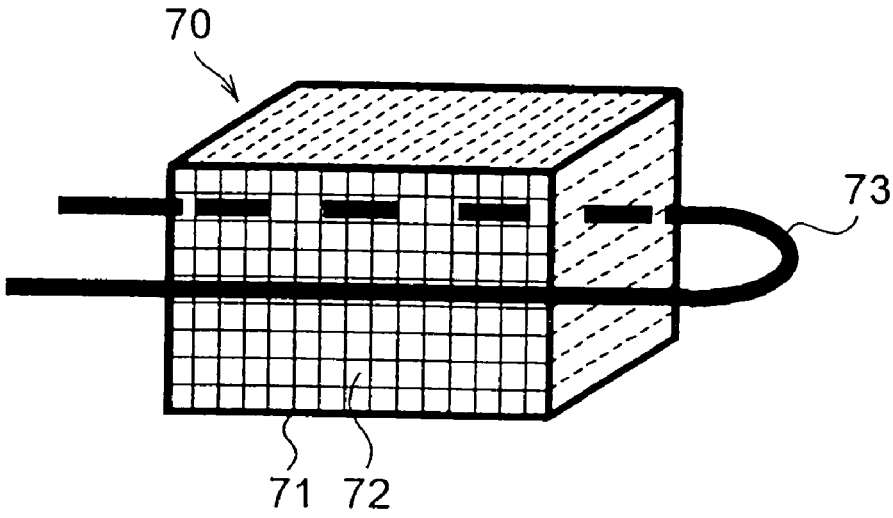
FIG. 3 is a perspective view of the catalyst block and the catalyst heater.

As shown in FIGS. 1 and 2, inside the upper duct 25 of the cooking oven 1, there is provided a catalyst block 70. The catalyst block 70 is arranged in an upstream-side portion inside the upper duct 25. The catalyst block 70 is shaped as shown in FIG. 3. Specifically, the catalyst block 70 is provided with a carrier block 71 in the shape of a rectangular parallelepiped having a large number of tubular vent ports 72 stacked up in the shape of a honeycomb, and this carrier block 71 supports a catalyst. As the carrier block 71 is used a "CORDURITE" honeycomb or a stainless steel corrugate honeycomb. A steel plate having an alloy of aluminum and zinc plated thereon, i.e., a GALVALUME steel plate, or a Galvalume steel plate subjected to chromate treatment may be used as the base material for the carrier member.

As the catalyst is used one based on a precious metal such as platinum or palladium or one based on manganese such as MnO, $MnO_2$, or Mn perovskite. To make the carrier block 71 support the catalyst, the former is painted, impregnated, or treated in any other manner with the latter depending on the material of the carrier block 71.

The catalyst block 70 needs to be used in a temperature range that permits it to function satisfactorily. To achieve this, as a heat source for heating the catalyst block 70, there is provided a catalyst heater. The upper heater 40, which is the main heat source for producing the hot air stream, is shared as the catalyst heater. In the first embodiment, the upper heater 40 is realized with a sheath heater, and part of it is laid near the catalyst block 70 so as to serve as the catalyst heater 73.

Figure 4:
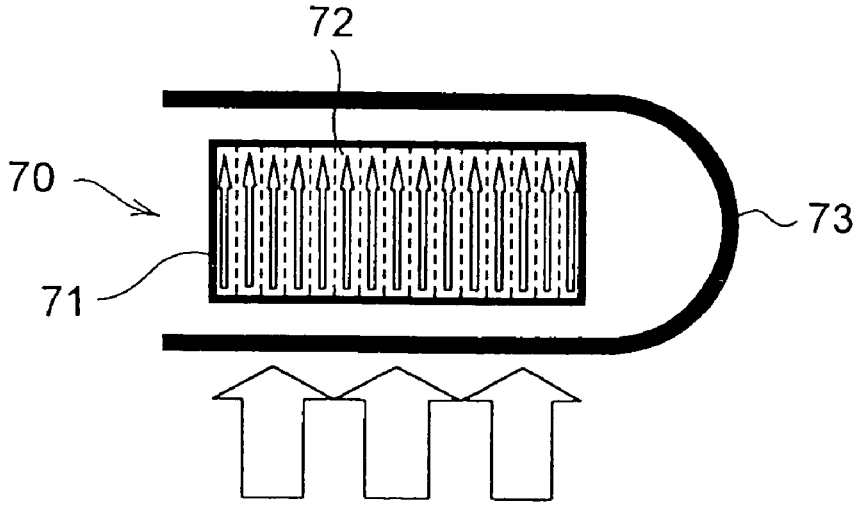
FIG. 4 is a sectional view showing how a hot air stream passes through the catalyst block.

The catalyst block 70 is arranged in such a way that the air stream passes through the inside of the tubular vent ports 72, i.e., in such a way that the length direction of the block as a whole is perpendicular to the air stream. This arrangement is shown in FIG. 4. The catalyst heater 73 is so formed as to face both the upstream and downstream surfaces, with respect to the air stream, of the so arranged catalyst block 70. In other words, the catalyst heater 73 is so shaped as to sandwich the catalyst block 70 from the front and rear sides thereof.

Figure 6:
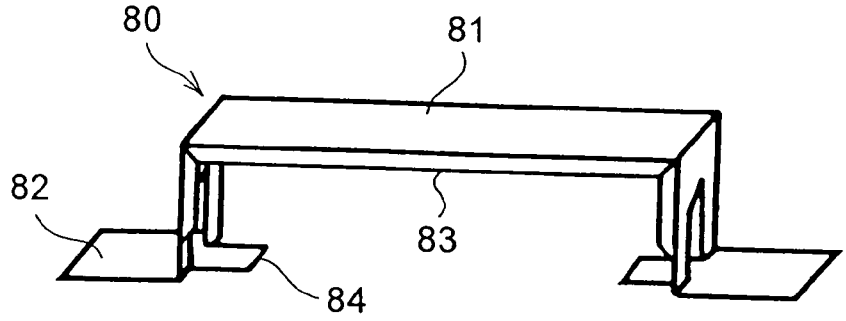
FIG. 6 is a perspective view of the catalyst block fitting member.

The catalyst block 70 is fitted to an interior wall surface of the upper duct 25, at a distance secured therefrom, by a metal fitting member 80 shaped as shown in FIG. 6. The fitting member 80 is formed by bending sheet metal. The fitting member 80 is composed of a frame portion 81 in the shape of a gate as seen in a front view and anchoring support portions 82 protruding outward from both ends of the frame portion 81. The frame portion 81 has, along the front-side and rear-side edges thereof, overhanging rims 83 formed so as to bent toward the inside of the frame portion 81. The overhanging rims 83 prevent the catalyst block 70 inserted in the frame portion 81 from moving frontward or rearward out. The overhanging rims 83 are formed as narrow as possible to minimize the reduction in the vent area of the catalyst block 70.

Figure 5:
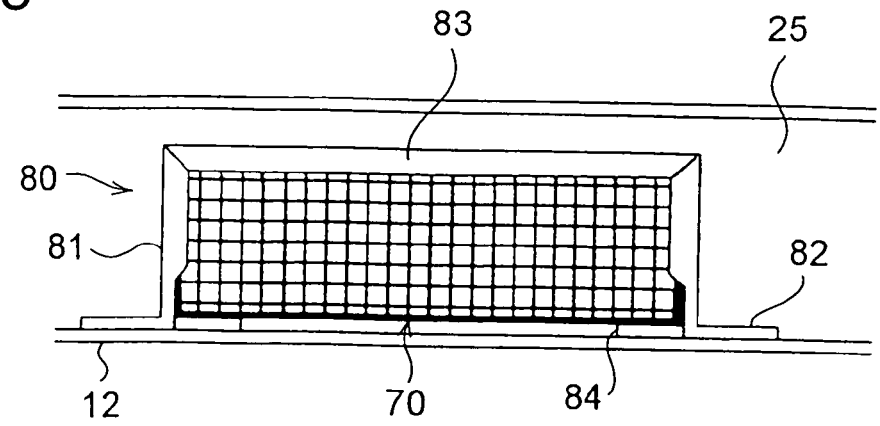
FIG. 5 is a front view of a principal portion, showing how the catalyst block is fitted.

When the catalyst block 70 is inserted in the frame portion 81 as shown in FIG. 5, the top, left-side, and right-side surfaces of the catalyst block 70 make surface contact with the inner surfaces of the frame portion 81. This state is maintained by cut-out pieces 84 that are cut out of the frame portion 81 so as to protrude in the opposite directions to the anchoring support portions 82. The cut-out pieces 84 support the bottom surface of the catalyst block 70, and thus, as shown in FIG. 5, the catalyst block 70 is kept at a distance from the surface to which it is fitted.

The fitting member 80, with the catalyst block 70 held therein, is then, as shown in FIG. 5, installed inside the upper duct 25 with the anchoring support portions 82 kept in contact with the floor surface (i.e., the upper surface of the ceiling wall 12 of the cooking chamber 11) of the upper duct 25. The anchoring support portions 82 are fastened to the ceiling wall 12 with screws so that the fitting member 80 itself along with the catalyst block 70 is fixed. The fitting member 80 does not make contact with the interior wall surfaces of the upper duct 25 except the one (the upper surface of the ceiling wall 12) to which the fitting member is fitted. The catalyst block 70 is held with a gap left from the ceiling wall 12.

The heat generated by the catalyst heater 73 heats not only the catalyst block 70 but also the air stream passing through the upper duct 25. Thus, the air stream heated by the catalyst heater 73 is further heated by the upper heater 40 so as to reach a desired temperature.

Catalyst paint 74 is applied (see FIG. 1) to the interior wall surfaces of the upper duct 25, starting around the downstream-side end of the catalyst block 70. The catalyst paint 74 contains, among its coating ingredients, a catalyst that is of the same type or functions in the same way as the one carried by the catalyst block 70.

Also inside the side duct 26, there are provided a catalyst block and a catalyst heater. As in the upper duct 25, the side heater 41, which is the main heat source for producing the hot air stream, is realized with a sheath heater, and part of it is laid near the catalyst block so as to serve as the catalyst heater. The catalyst block in the side duct 26 is fixed by a fitting member similar to the fitting member 80. The fitting member is fixed to the left inner wall 15.

Catalyst paint similar to that used in the upper duct 25 is applied to the interior wall surfaces of the side duct 26, starting around the downstream-side end of the catalyst block.

In FIG. 1, reference number 60 represents foods, and reference number 61 represents a grill that supports foods 60 above a turntable 50.

The cooking oven 1 of the first embodiment operates as follows. When heating cooking is started, air is sucked out of the cooking chamber 11 into the blower 20, and is sent to the upper duct 25 and the side duct 26. The air stream that has entered the upper duct 25 is heated by the catalyst heater 73 and the upper heater 40, and is then, in the form of a hot air stream, blown out through the upper blowout port 30. The air stream that has entered the side duct 26 is heated by the catalyst heater and the upper heater 41, and is then, in the form of a hot air stream, blown out through the side blowout port 31.

The heat generated by the catalyst heater 73 and the upper heater 40 heats the catalyst block 70. The catalyst block 70 is heated, by the radiant heat received from the upstream and downstream sides thereof and the heat carried by the hot air stream passing therethrough, to a temperature (310° C. to 600° C.) at which the catalyst functions satisfactorily. The catalyst paint 74 also is heated, by the radiant heat from the catalyst heater 73 and the upper heater 40 and the heat carried by the hot air stream passing through the inside of the upper duct 25, to a temperature (200° C. to 400° C.) at which the catalyst functions satisfactorily. Likewise, inside the side duct 26, the catalyst block and the catalyst paint are heated.

The hot air stream blown into the cooking chamber 11 heats foods 60. As foods 60 are heated, it releases oily fumes and odor substances. The oily fumes and odor substances, mixed with the hot air stream, are sucked through the suction port 32 into the blower 20, and is then sent out into the upper duct 25 and the side duct 26.

The oily fumes and odor substances that have entered the upper duct 25 are, as they pass through the catalyst block 70, decomposed into carbon dioxide and water. The oily fumes and odor substances that have passed through the catalyst block 70 without being decomposed and those that have passed through the gap between the catalyst block 70 and the interior wall surfaces of the upper duct 25 flows further through the upper duct 25 toward the upper blowout port 30, and meanwhile make contact with the catalyst paint 74 so as to be decomposed. Likewise, the oily fumes and odor substances that have entered the side duct 26 are decomposed by the catalyst block and the catalyst paint.

Accordingly, the hot air streams that blow out from the upper and side blowout ports 30 and 31 contain greatly reduced amounts of oily fumes and odor substances, and are thus less likely to stain foods 60 or spoil the flavor thereof. Also less soiled are the cooking chamber 11 and the blower 20.

Now, different embodiments of the cooking oven 1 described above will be described. A second to an eleventh embodiment, which will be described below, are all characterized by the shape or structure of the fitting member for the catalyst block 70, or how it is fitted. The following descriptions assume that the second to eleventh embodiments are applied to the fitting member 80 used in the upper duct 25, but it should be understood that they are applicable also to the fitting member used in the side duct 26 except in cases where spatial positional relationship matters.

Figure 7:
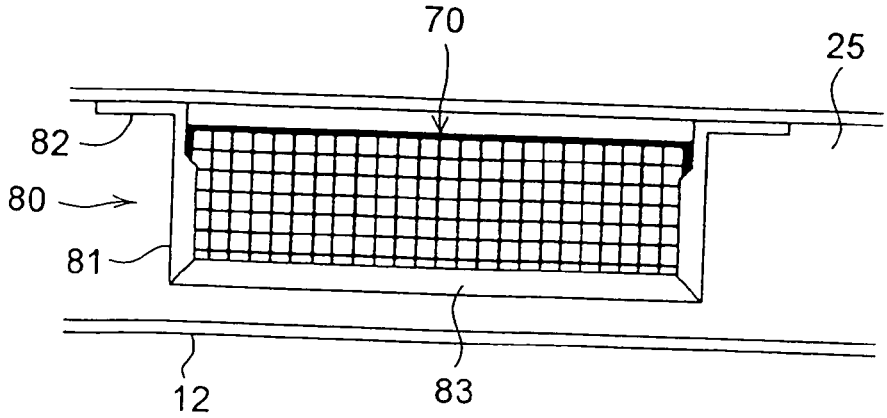
FIG. 7 is a front view of a principal portion, like FIG. 5, of a second embodiment of a cooking oven according to the invention.

FIG. 7 shows a second embodiment. The fitting member 80 is fitted not on the upper surface of the ceiling wall 12 but to the ceiling surface of the upper duct 25. In this construction, the catalyst block 70, acted upon by gravitation, spontaneously falls onto the bottom of the frame portion 81 and leaves a gap from the ceiling surface of the upper duct 25. This makes it possible to omit the cut-out pieces 84.

Figure 8:
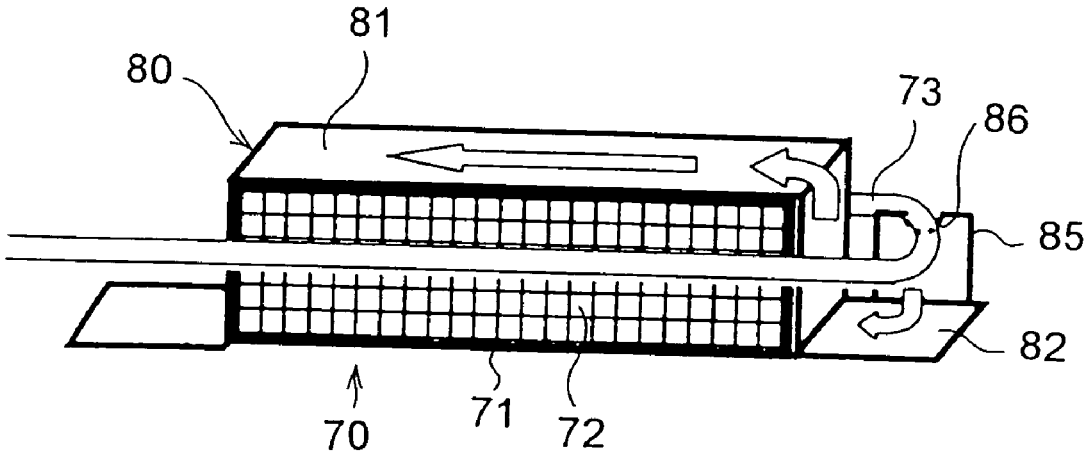
FIG. 8 is a perspective view of the catalyst block portion, showing a third embodiment of a cooking oven according to the invention.
Figure 9:
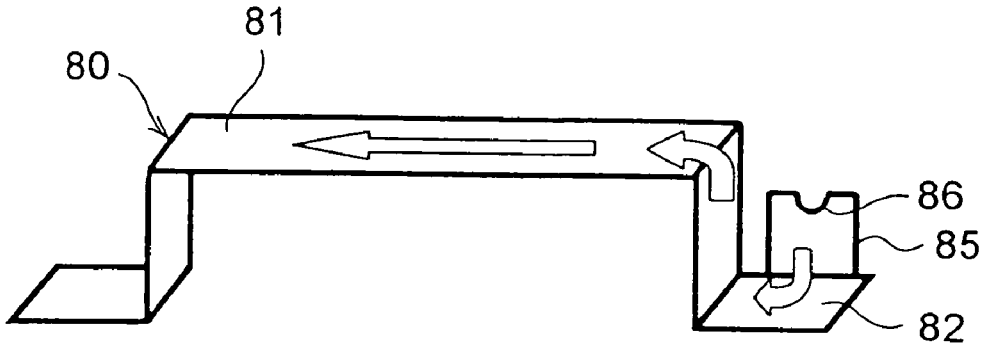
FIG. 9 is a perspective view of the fitting member of the third embodiment.

FIGS. 8 and 9 show a third embodiment. A heater support portion 85 for supporting the bent portion formed at a midpoint of the catalyst heater 73 is formed integrally with one of the anchoring support portions 82 of the fitting member 80. The heater support portion 85 has an engagement cut 86 formed in an edge thereof so that the catalyst heater 73 is fitted into it. Thus, the heater support portion 85 holds the catalyst heater 73 in such a way that the catalyst heater 73 does not make contact with the catalyst block 70.

As described earlier, the fitting member 80 is made of a metal having a high thermal conductivity. Moreover, the frame portion 81 is kept in surface contact with the top, left-side, and right-side surfaces of the catalyst block 70. Thus, as shown in FIG. 9, the heat generated by the catalyst heater 73 conducts from the heater support portion 85 to the frame portion 81 and then to the catalyst block 70. This permits the catalyst block 70 to be heated efficiently.

Figure 10:
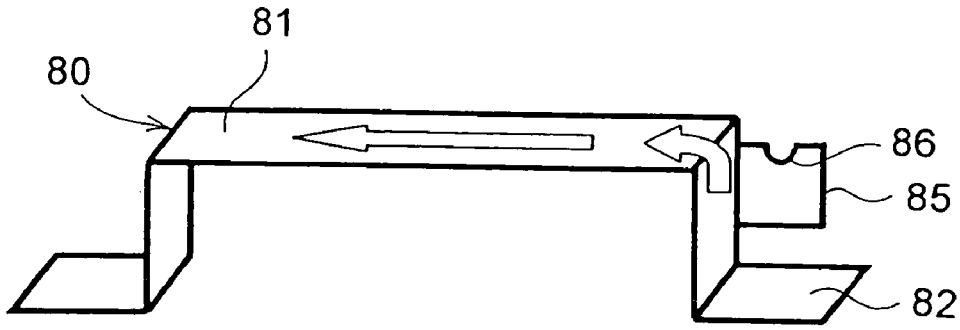
FIG. 10 is a perspective view of the fitting member, showing a fourth embodiment of a cooking oven according to the invention.

FIG. 10 shows a fourth embodiment. The heater support portion 85 is formed in a different part of the fitting member 80. In the third embodiment, the heater support portion 85 is fitted to, among the pieces that together form the fitting member 80, the one that is fitted to the upper duct 25, namely one of the anchoring support portion 82. This permits the heat conducted from the catalyst heater 73 to readily escape to the walls of the upper duct 25. To improve this, the heater support portion 85 is formed integrally with the piece that makes surface contract with the side surface of the catalyst block 70. This permits the heat generated by the catalyst heater 73 to conduct to the catalyst block 70 more efficiently.

The fitting member 80 also receives infrared radiation from the catalyst heater 73 and the upper heater 40. From the perspective of efficient heating of the catalyst block 70, it is desirable that the fitting member 80 readily absorb radiant heat, i.e., infrared radiation. To this end, the fitting member 80 is used in a form deprived of its inherent metallic luster.

Specifically, as the metal material of which the fitting member 80 is made is selected one whose reflectivity lessens or whose color darkens when a certain amount of heat is applied thereto. The color of the fitting member 80 may be changed by application of heat in the process of its being formed, or may be changed as a result of the fitting member 80 being heated as the cooking oven 1 is used.

An example of such a metal material is stainless steel SUS304 (a code indicating a particular type of stainless steel according to the Japanese Industrial Standards). This type of steel, as the catalyst block 70 is heated to a temperature (310° C. to 600° C.) at which the catalyst functions satisfactorily, loses the luster inherent in stainless steel and comes to have a different color. It even then maintains resistance to corrosion. Thus, this material is suitable for the purpose of the invention.

Figure 11:
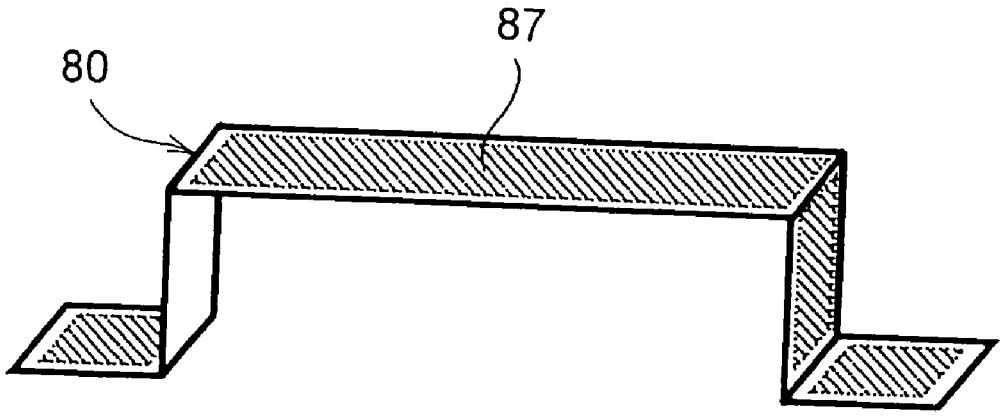
FIG. 11 is a perspective view of the fitting member, showing a fifth embodiment of a cooking oven according to the invention.

The infrared absorption coefficient of the fitting member 80 may be further increased by some means. In a fifth embodiment shown in FIG. 11, paint of a dark color, such as black, brown, or green, is applied to the fitting member 80. This permits the fitting member 80 to absorb more radiant heat, and thus helps increase the efficiency with which the catalyst block 70 is heated. The paint does not need to be applied to those portions of the fitting member 80 where it makes surface contact with the catalyst block 70 and with the floor surface of the upper duct 25.

Figure 12:
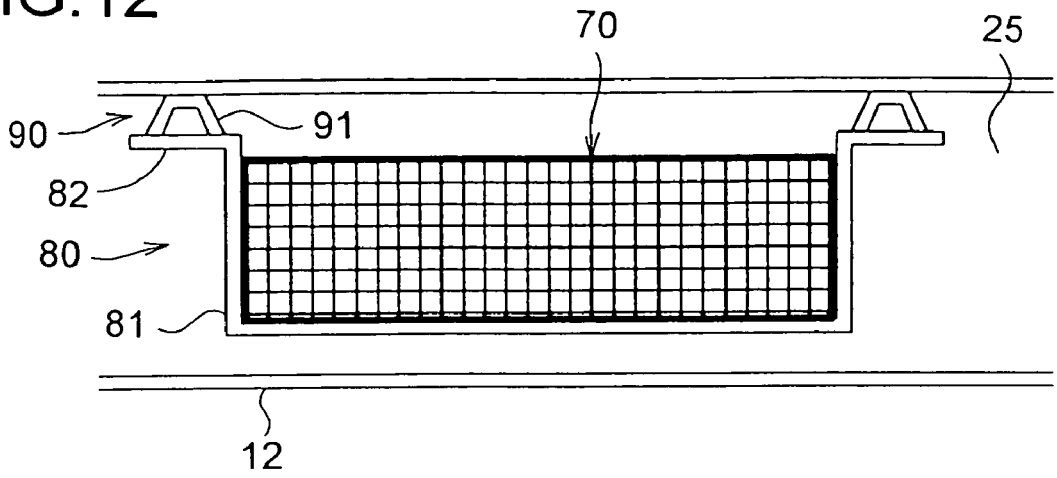
FIG. 12 is a front view of a principal portion, like FIG. 5, of a sixth embodiment of a cooking oven according to the invention.
Figure 13:
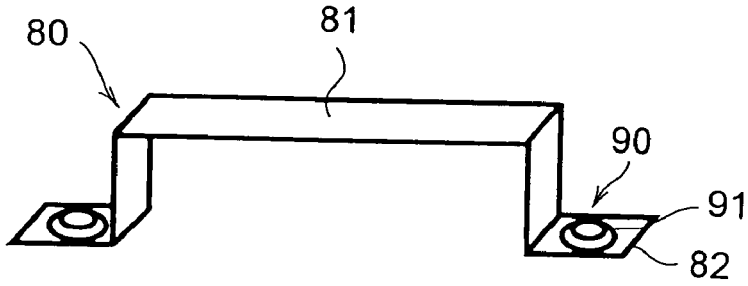
FIG. 13 is a perspective view of the fitting member of the sixth embodiment.

FIGS. 12 and 13 show a sixth embodiment. As in the second embodiment, the fitting member 80 is fitted to the ceiling surface of the upper duct 25. Here, however, a heat-shielding portion 90 is provided between the anchoring support portions 82 and the upper duct 25. Although the term "heat-shielding" is used here, it is impossible to completely shield heat in reality. Accordingly, it should be understood that the term "heat-shielding" used here includes the concept of "reducing conduction of heat."

In the sixth embodiment, the heat-shielding portion 90 is realized with projections 91 formed on the anchoring support portions 82. The projections 91 can be formed by drawing. The contact achieved between the projections 91 and the interior wall surface of the upper duct 25 helps reduce the contact area between the fitting member 80 and the interior wall surface of the upper duct 25. This limits the conduction of heat from the fitting member 80 to the walls of the upper duct 25, and thus more of the heat received by the fitting member 80 conducts to the catalyst block 70.

The projections 91 may be formed not on the anchoring support portions 82 but on the upper duct 25. Alternatively, projections 91 may be formed both on the anchoring support portions 82 and on the upper duct 25 so that they are brought into contact with each other.

Figure 14:
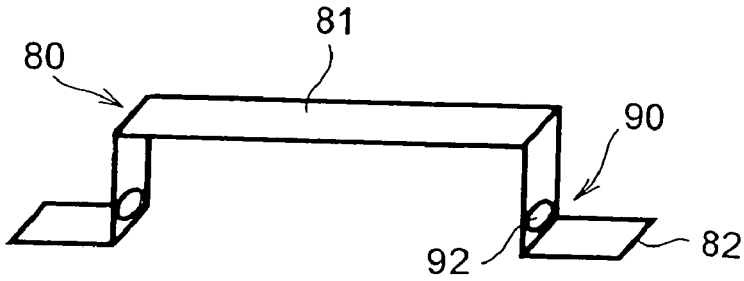
FIG. 14 is a perspective view of the fitting member, showing a seventh embodiment of a cooking oven according to the invention.

FIG. 14 shows a seventh embodiment. Also in this embodiment, the fitting member 80 is provided with a heat-shielding portion 90. In the seventh embodiment, the heat-shielding portion 90 is realized with through holes 92 formed in the vertical portions of the frame portion 81 located just above the anchoring support portions 82. These through holes 92 help reduce the cross-sectional area there, and thus helps reduce the amount of heat that conducts to the anchoring support portions 82.

Instead of the through holes 92, cuts may be formed in the edges of the frame portion 81 to serve as the heat-shielding portion 90.

Figure 15:
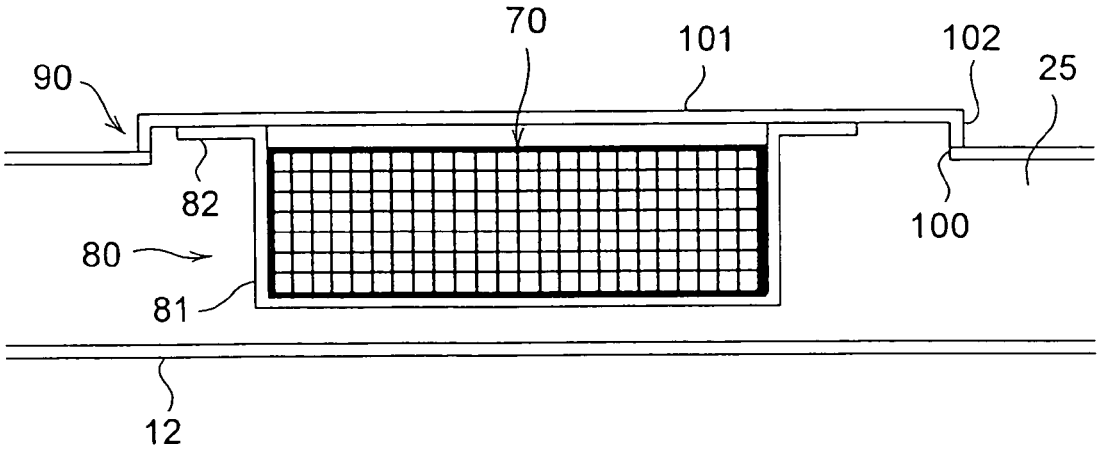
FIG. 15 is a front view of a principal portion, like FIG. 5, of an eighth embodiment of a cooking oven according to the invention.

FIG. 15 shows an eighth embodiment. In this embodiment, a catalyst replacement opening 100 is formed in the upper duct 25, and is covered with a lid 101 from outside the upper duct 25. The lid 101 is fixed to the upper duct 24 as by being fastened thereto with screws. To the inner surface of this lid 101 is fitted the fitting member 80 with the catalyst block 70 held therein.

The lid 101 is formed out of sheet metal, and has a bent portion 102 formed along the edges thereof. The rim of the bent portion 102 makes contact with the upper duct 25, and thus the area over which the bent portion 102 makes contact with the upper duct 25 is small. That is, the bent portion 102 forms a small-area contact portion interposed between the fitting member 80 and the upper duct 25, and thus serves as the heat-shielding portion 90.

Figure 16:
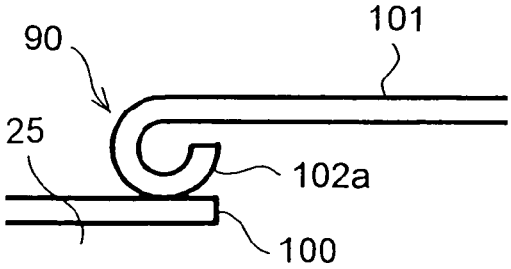
FIG. 16 is an enlarged partial sectional view showing a ninth embodiment of a cooking oven according to the invention.

FIG. 16 shows a ninth embodiment. In this embodiment, the edges of the lid 101 for covering the catalyst replacement opening 100 are formed not into a simply bent portion but into a curled portion 102*a*. This also helps reduce the contact area between the upper duct 25 and the lid 101, and thus serves as the heat-shielding portion 90.

Figure 17:
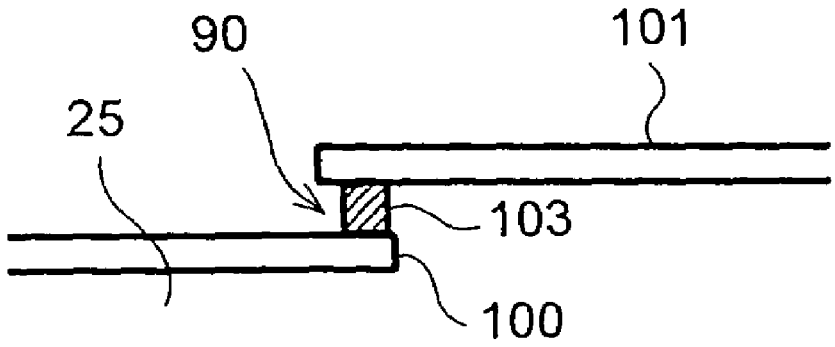
FIG. 17 is an enlarged partial sectional view showing a tenth embodiment of a cooking oven according to the invention.

FIG. 17 shows a tenth embodiment. In this embodiment, between the upper duct 25 and the lid 101 is interposed a heat-shielding member 103 to serve as the heat-shielding portion 90. The heat-shielding member 103 is made of a material having a low thermal conductivity such as heat-resistant resin or ceramic. Using the heat-shielding member 103 helps achieve higher-level heat shielding.

Selecting synthetic resin as the material of the heat-shielding member 103 makes it easy to form it into a shape that runs along the contour of the lid 101. Moreover, it is possible to exploit the elasticity of the synthetic resin to keep airtightness between the upper duct 25 and the lid 101.

Figure 18:
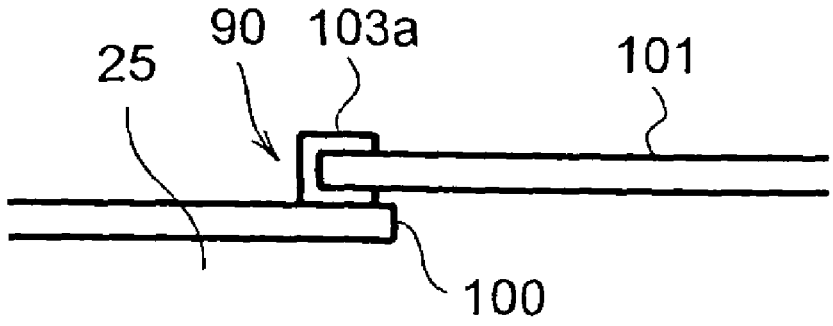
FIG. 18 is an enlarged partial sectional view showing an eleventh embodiment of a cooking oven according to the invention.

FIG. 18 shows an eleventh embodiment. In this embodiment, highly elastic synthetic resin is selected as the heat-shielding member. This synthetic resin is formed into a shape having a C-shaped cross section and is fitted around the lid 101 to form a heat-shielding member 103*a* having a sealing capability. This makes it possible to permit a single member to serve both as the heat-shielding portion 90 and to keep airtightness.

The embodiments starting with the eighth shown in FIG. 15 and ending with the eleventh shown in FIG. 18 all relate to the structure of the heat-shielding portion 90 as used in constructions in which the fitting member 80 for the catalyst block 70 is fitted to the lid 101 for covering the catalyst replacement opening 100. A similarly structured heat-shielding portion 90 may be fitted to a fitting member 80 that is fitted directly to an interior wall surface of the upper duct 25 without a lid 101 interposed in between.

FIGS. 19 to 25 show a twelfth to a fifteenth embodiment, respectively. The twelfth to fifteenth embodiments all relate to the catalyst paint applied inside a duct. Although the upper duct 25 is illustrated as the target to which these embodiments are applied, it should be understood that they are equally applicable to the side duct 26.

Figure 19:
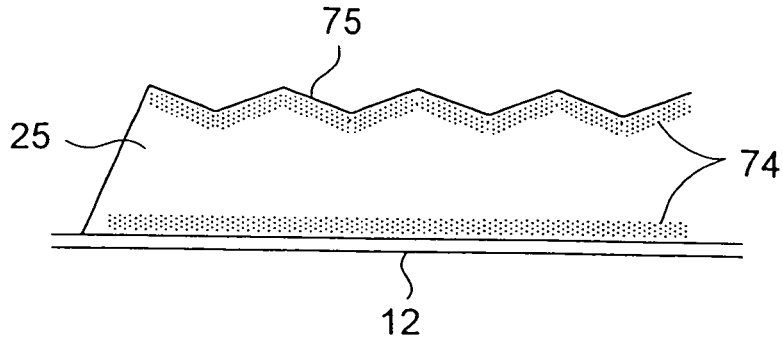
FIG. 19 is a partial vertical sectional view showing a twelfth embodiment of a cooking oven according to the invention.

FIG. 19 shows a twelfth embodiment of the cooking oven 1. In this embodiment, one of the interior wall surfaces of the upper duct 25, i.e., the one that does not form the ceiling wall 12 of the cooking chamber 11, is formed into an irregular surface 75. The catalyst paint 74 is applied to the irregular surface 75, and thus the surface, even with the same area as seen in a plan view, makes contact with the air stream over a larger effective area. This helps enhance the decomposition performance of the catalyst paint 74 as a whole. Instead of forming only the interior wall surface opposite to the ceiling wall 12 into a irregular surface 75, it is also possible, and more preferable, to form all the four interior wall surfaces of the upper duct 25 into irregular surfaces and apply the catalyst paint 74 thereto. Likewise, the interior wall surfaces of the side duct 26 are formed into irregular surfaces, and the catalyst paint 74 is applied thereto.

An irregular surface 75 can be formed by forming a large number of dimples on an interior wall surface of a duct or by bonding thereto a sheet having punched holes or laths formed thereon.

Figure 20:
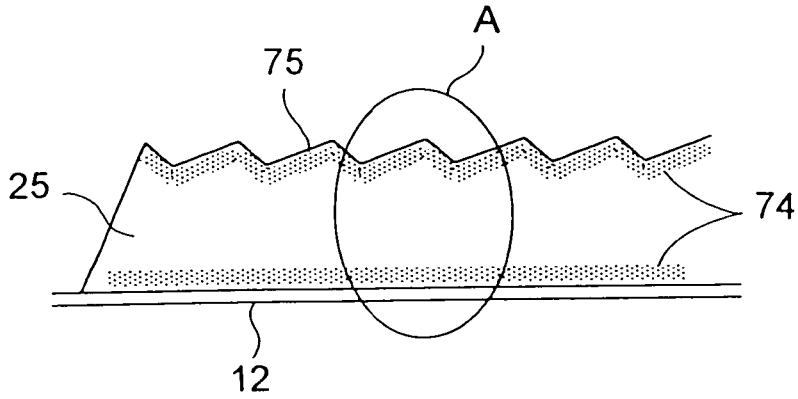
FIG. 20 is a partial vertical sectional view showing a thirteenth embodiment of a cooking oven according to the invention.
Figure 21:
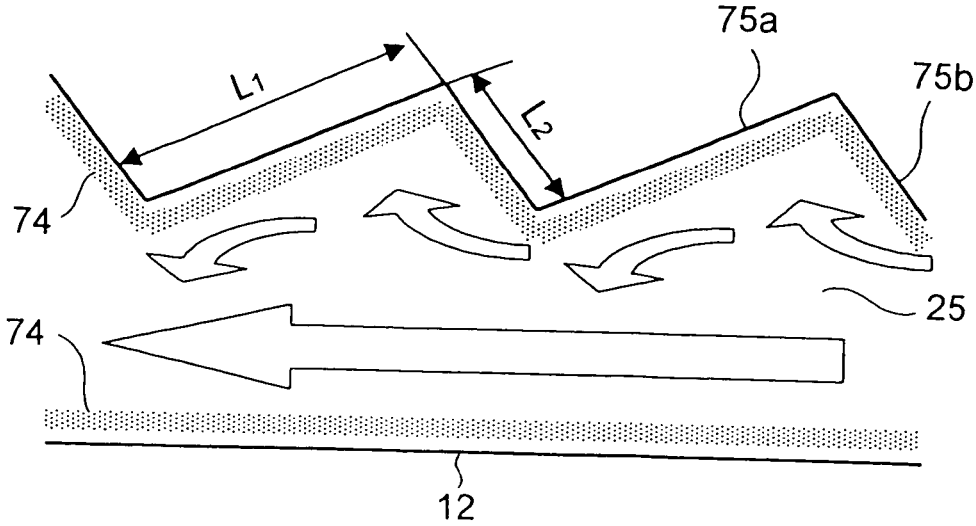
FIG. 21 is an enlarged view of the portion shown in ellipse A in FIG. 21.

FIGS. 20 and 21 show a thirteenth embodiment of the cooking oven 1. In this embodiment, the surface irregularities on an interior wall surface of the upper duct 25 are formed as follows. An irregular surface 75 has wave-shaped irregularities composed of slanted surfaces 75*a* that face in the direction from which the air stream blows and slanted surfaces 75*b* that face in the direction opposite thereto. When the length $L_1$ of the slanted surfaces 75*a* is compared with the length $L_2$ of the slanted surfaces 75*b*, the length $L_1$ is long, and the length $L_2$ is short. Since the slanted surfaces 75*a*, with which the air stream collides, are longer, the catalyst paint 74 as a whole exerts still higher decomposition performance. All the four interior wall surfaces of the upper duct 25 may be formed into irregular surfaces 75. A similar structure may be applied to an interior wall surface of the side duct 26.

Figure 22:
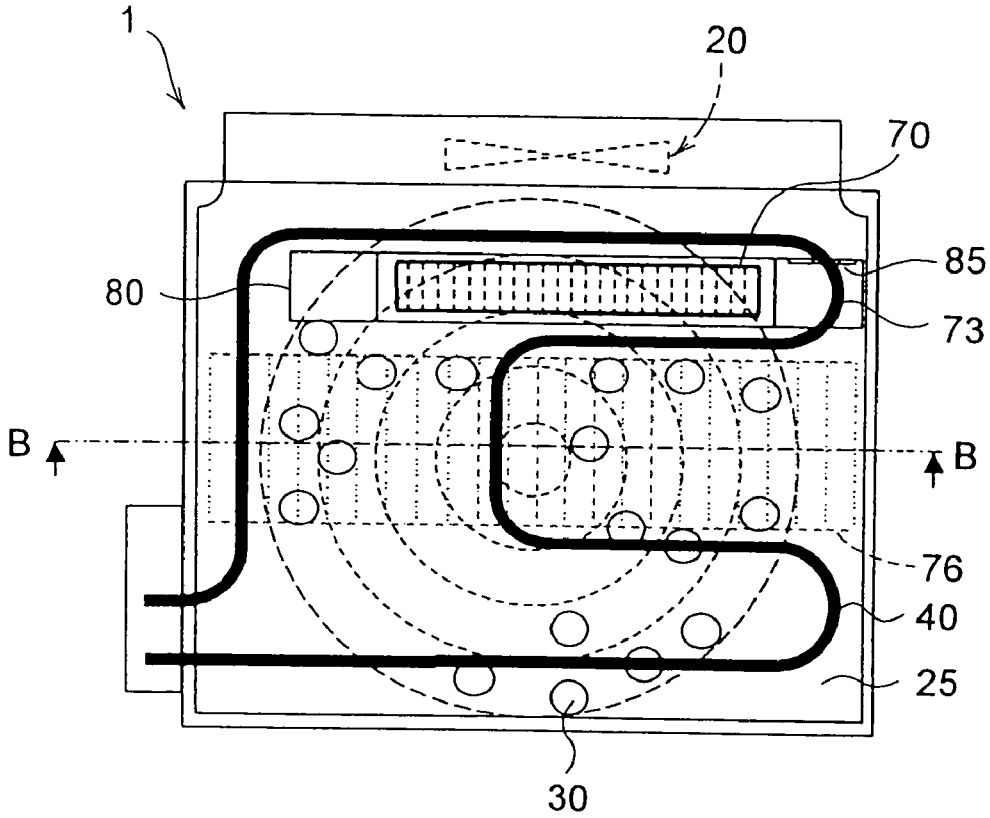
FIG. 22 is a schematic horizontal sectional view showing a fourteenth embodiment of a cooking oven according to the invention.
Figure 23:
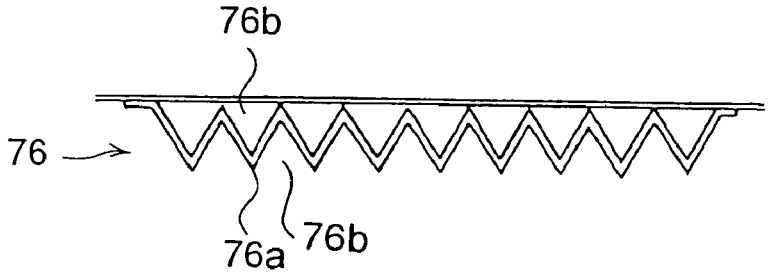
FIG. 23 is a partial sectional view taken along line B-B shown in FIG. 22.

FIGS. 22 and 23 show a fourteenth embodiment of the cooking oven 1. In the cooking oven 1 of the fourteenth embodiment, to increase the area of the catalyst paint surface, ridge-shaped or groove-shaped irregularities are formed along the air stream inside the upper duct 25. To this end, a corrugate plate 76 is fixed to an interior wall surface of the upper duct 25. The corrugate plate 76 has a cross-sectional shape as shown in FIG. 23 so as to have grooves 76*b* between triangular ridges 76*a*. The grooves 76*b* are formed on both sides of the corrugate plate 76.

The corrugate plate 76 is made of metal, and has catalyst paint applied on both sides thereof. Catalyst paint is applied also to the part of an interior wall surface of the upper duct 25 located on the downstream side of the catalyst block 70, and the corrugate plate 76, having the catalyst paint already applied thereto, is fixed to that interior wall surface as by being fastened with screws.

In this construction, the catalyst paint surface has an increased area. Moreover, since the ridges 76*a* or grooves 76*b* run along the air stream, they do not diminish the flow speed of the air stream. This makes it possible to send the hot air stream efficiently while keeping it in contact with the catalyst paint. The side duct 26 is given a similar structure.

Figure 24:
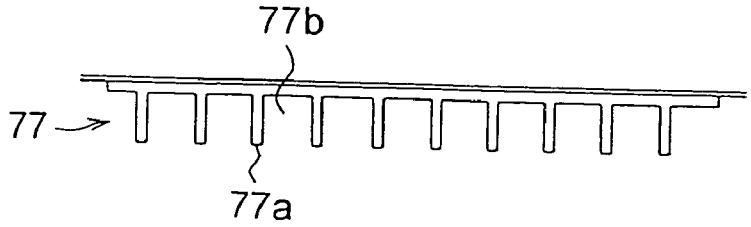
FIG. 24 is a partial sectional view, like FIG. 23, showing a fifteenth embodiment of a cooking oven according to the invention.

FIG. 24 shows a fifteenth embodiment of the cooking oven 1. In this embodiment, instead of the corrugate plate 76, an extruded member 77 provided with a large number of parallel fins 77*a* is used. Between the parallel fins 77*a* are formed grooves 77*b* through which the air stream passes. The extruded member 77 is made of metal, and is fixed, as by being fastened with screws, to the portion of an interior wall of the upper duct 25 located on the downstream side of the catalyst block 70. Then, catalyst paint is applied to the interior wall surface of the upper duct 25 including the extruded member 77.

Also in this construction, the catalyst paint surface has an increased area. Moreover, since the parallel fins 77*a* and the grooves 77*b* between them run along the air stream, they do not diminish the flow speed of the air stream. This makes it possible to send the hot air stream efficiently while keeping it in contact with the catalyst paint. The side duct 26 is given a similar structure.

Figure 25:
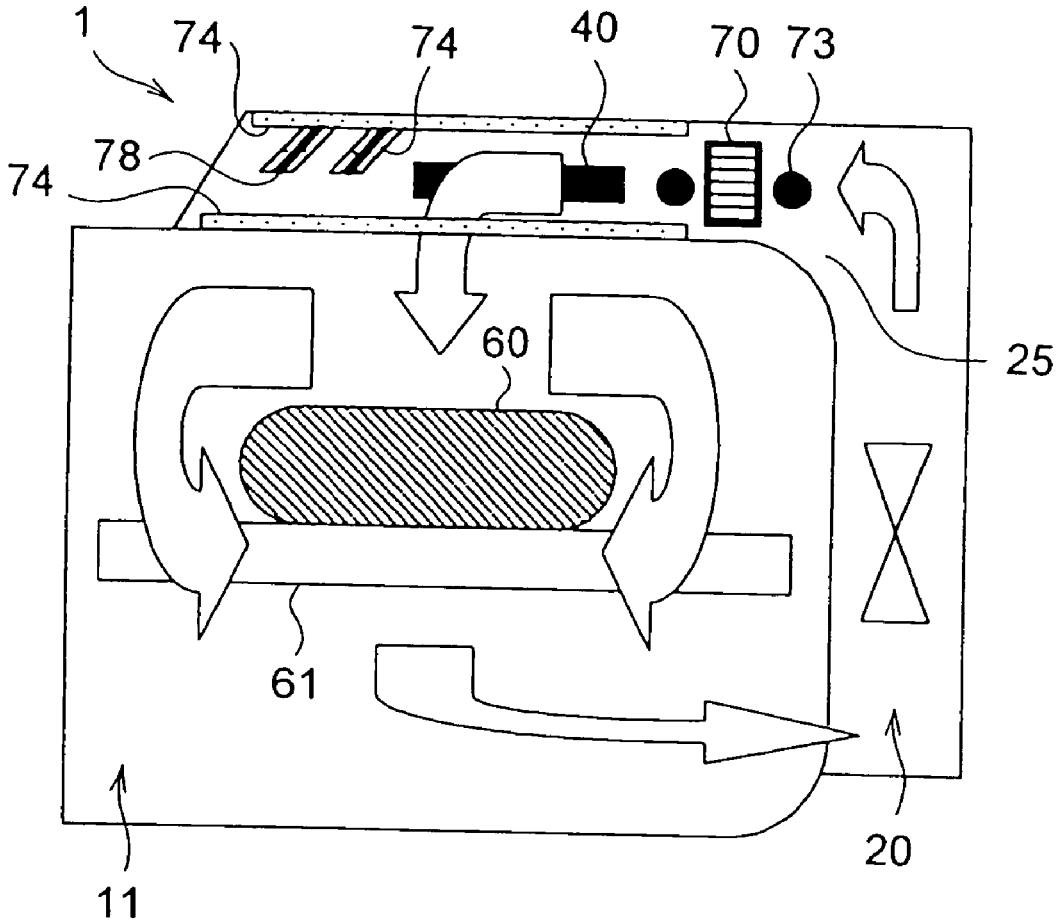
FIG. 25 is a schematic vertical sectional view showing a sixteenth embodiment of a cooking oven according to the invention.

FIG. 25 shows a sixteenth embodiment of the cooking oven 1. In the cooking oven 1 of the sixteenth embodiment, inside the upper duct 25, there is provided a air-stream-regulating plate 78 for directing the air stream in the direction of the upper blowout port 30 and simultaneously regulating the air stream. Catalyst paint 74 is applied to an interior wall surface of the upper duct 25 including the air-stream-regulating plate 78.

Also in this construction, the catalyst paint surface has an increased area. Moreover, since the air stream is surely kept in contact with the air-stream-regulating plate 78, the catalyst paint 74 surely functions satisfactorily. The side duct 26 is given a similar structure.

Figure 26:
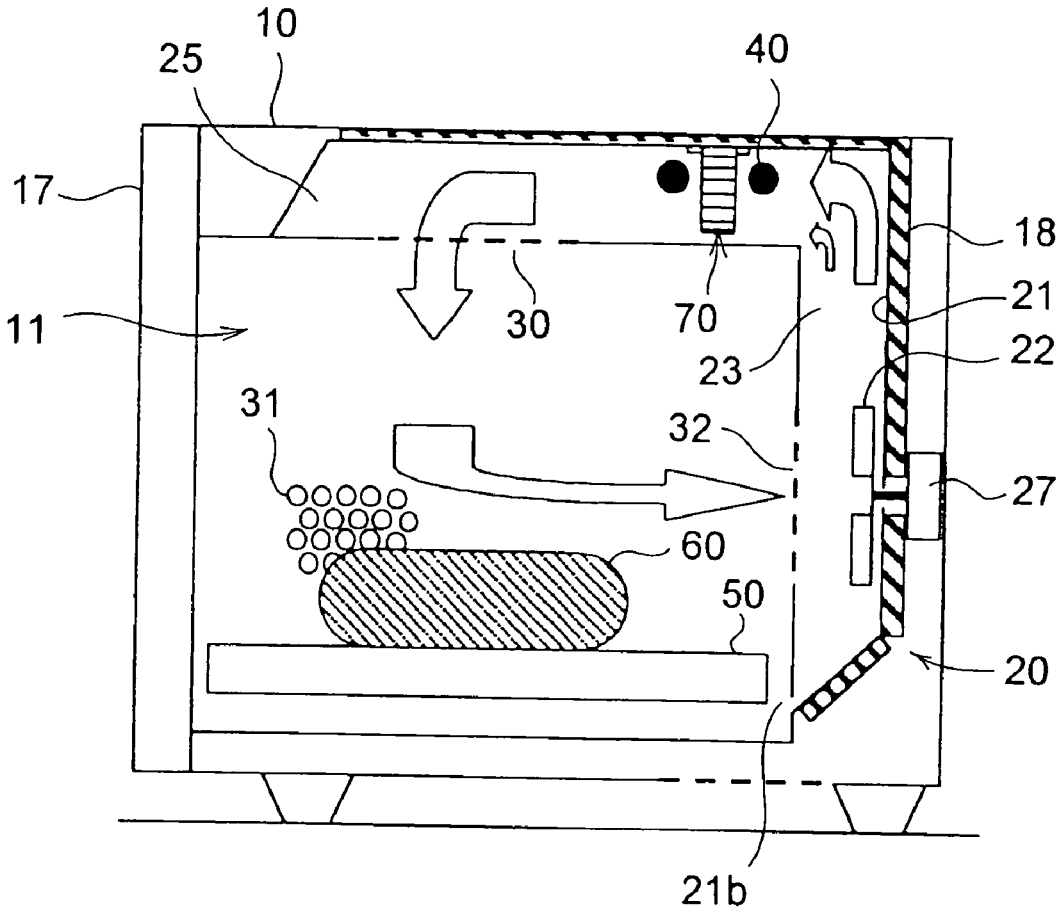
FIG. 26 is a schematic vertical sectional view showing a seventeenth embodiment of a cooking oven according to the invention.
Figure 27:
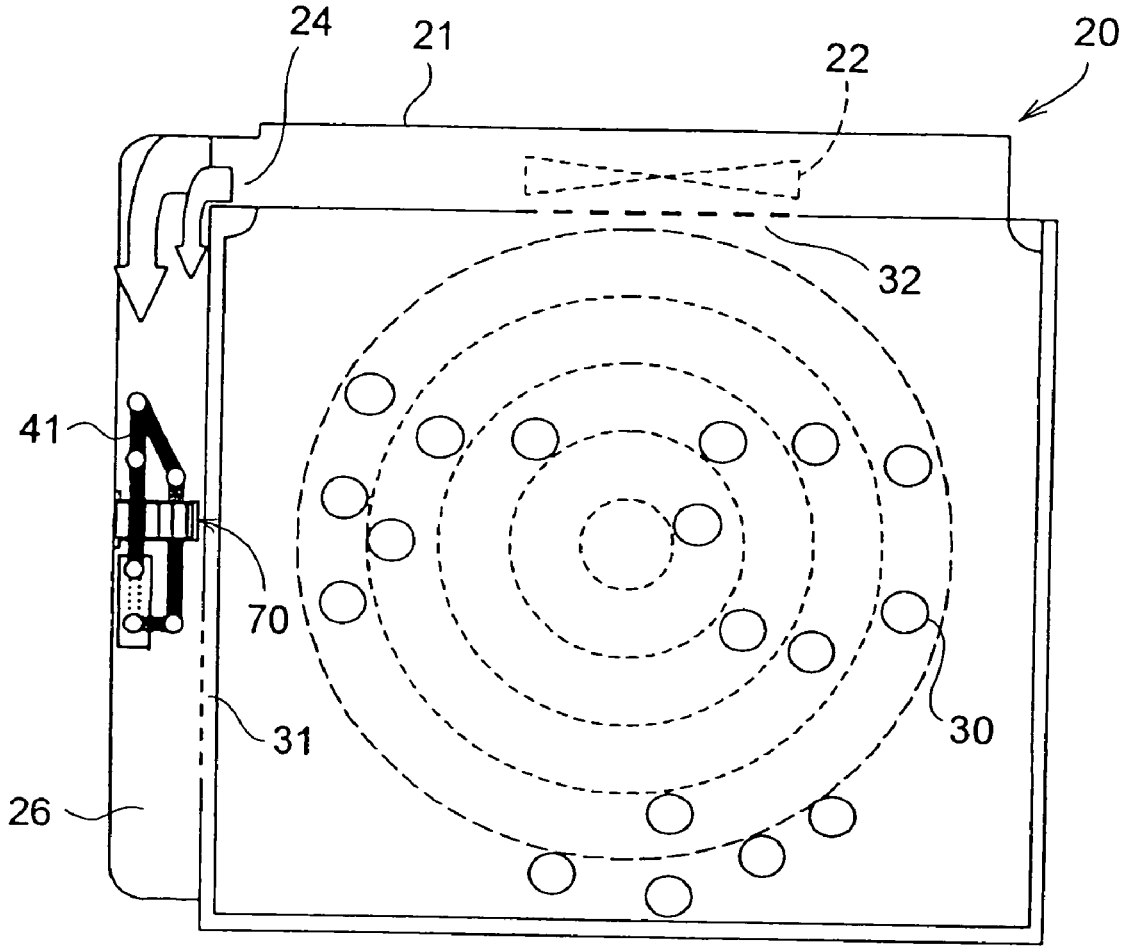
FIG. 27 is a schematic horizontal sectional view of the cooking oven of the seventeenth embodiment.
Figure 28:
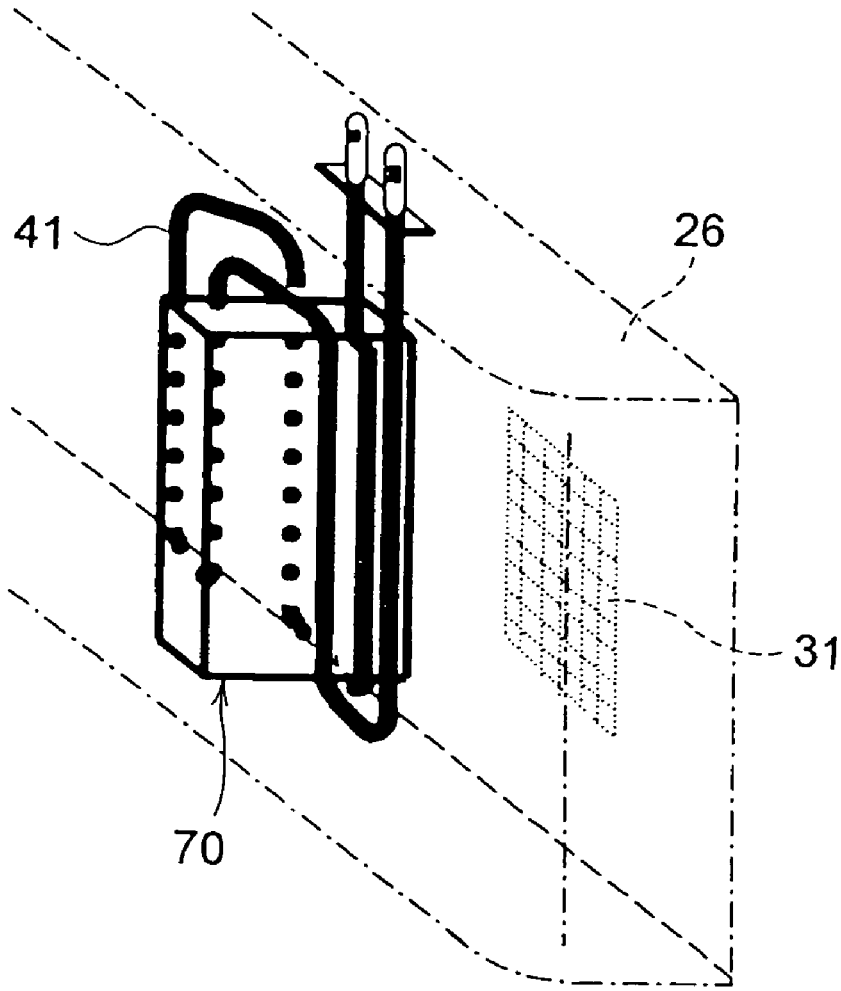
FIG. 28 is a partial perspective view showing the arrangement of the horizontal heater and the catalyst block relative to each other.

FIGS. 26, 27, and 28 show a seventeenth embodiment of the cooking oven 1.

When the fan 22 sucks in air out of the cooking chamber 11, fine particles of oil released from foods 60, together with the air, enters the fan casing 21. Most of the oil that has entered is then sent, together with the air, into the upper duct 25 or the side duct 26, and is decomposed by the catalyst. However, part of the oil, while passing through the fan casing 21, settles on the interior wall surfaces thereof. As time passes, more and more oil settles on the interior wall surfaces of the fan casing 21 until the oil, in the form of oil drips, starts to flow down the wall surfaces. This oil flows through an oil drain hole 21*b* into the cooking chamber 11. On an occasion of cleaning, the oil is wiped off along with the oil that has settled on the interior surfaces of the cooking chamber 11.

Air flows through the inside of the upper duct 25 and of the side duct 26. Suppose that there is a grid across a cross-section of the duct, and compare the amounts of air stream that flow through the individual squares of the grid. Then, the amounts of air stream that flow through different squares are not equal, but larger amounts of air stream pass through some squares than through others.

When the duct is curved or bent, the air flowing therethrough is acted upon by centrifugal force. This causes an increasingly large amount of air, and thus an increasingly large amount of air stream, to flow through an increasingly outward part of the curve or bend. This tendency persists even after the air has exited from the curve or bend and entered a straight path, and accordingly an increasingly large amount of air stream flows through the part of the straight path that is contiguous with an increasingly outward part of the curve or bend.

According to the present invention, from this perspective, the arrangement of the heaters and the catalyst blocks is ingeniously worked out.

First, a description will be given of the heaters. The upper heater 40 and the side heater 41 are each a sheath heater, and are arranged so as to describe a complicatedly bent shape across a cross-section of the upper duct 25 and the side duct 26, respectively. The main portions of those sheath heaters, i.e., those portions thereof where they generate a large amount of heat, are laid in a ceiling-side portion inside the upper duct 25 (see FIG. 26) and in a left-side portion, as seen from the front, inside the side duct 26 (see FIG. 27), respectively.

As shown in FIG. 26, the upper duct 25 is bent in a portion thereof that connects to the upper discharge port 23 of the fan casing 21, and the upper heater 40 is arranged on the downstream side of this bent portion. The distribution of the amount of air stream within a cross section of the upper duct 25 is such that more air stream flows through a more outward, i.e., closer to the ceiling, part of the bent portion. The distribution of the amount of heat generated by the upper heater 40 is adjusted to this distribution of the amount of air stream, specifically in such a way that more heat is generated in a part where more air stream flows, and the heater is so shaped as to meet that requirement. As a result, different parts of the air flowing through a cross section of the duct receive, according to the amount of air stream that flows there, commensurate amounts of heat, achieving efficient heating of air.

With respect to the side duct 26, as shown in FIG. 27, it is bent in a portion thereof that connects to the side discharge port 24 of the fan casing 21, and the side heater 41 is arranged on the downstream side of this bent portion. Thus, the distribution of the amount of air stream within a cross section of the side duct 26 is such that more air stream flows through a more outward, i.e., more leftward as seen from the front, part of the bent portion. The distribution of the amount of heat generated by the side heater 41 is adjusted to this distribution of the amount of air stream, specifically in such a way that more heat is generated in a part where more air stream flows, and the heater is so shaped as to meet that requirement. As a result, different parts of the air flowing through a cross section of the duct receive, according to the amount of air stream that flows there, commensurate amounts of heat, achieving efficient heating of air.

The catalyst block 70 is arranged lopsided toward that side of a cross section of the duct at which a larger amount of heat is generated. Specifically, in the upper duct 25, the catalyst block 70 is fitted to the ceiling wall thereof, and, in the side duct 26, the catalyst block 70 is fitted to the left-hand interior side wall thereof as seen from the front.

The fitting member 80 having the catalyst block 70 held therein is fastened, in the upper duct 25, to the ceiling wall thereof with screws and, in the side duct 26, to the left-hand interior side wall thereof, as seen from the front, with screws.

In this way, the catalyst block 70 is fitted to that one of the duct interior walls (of which the ceiling wall is one) which is located where the upper heater 40 or side heater 41 generates a larger amount of heat. As a result, as well as with directly radiated heat, with the heat conducted through the duct walls, the catalyst block is heated efficiently.

Figure 29:
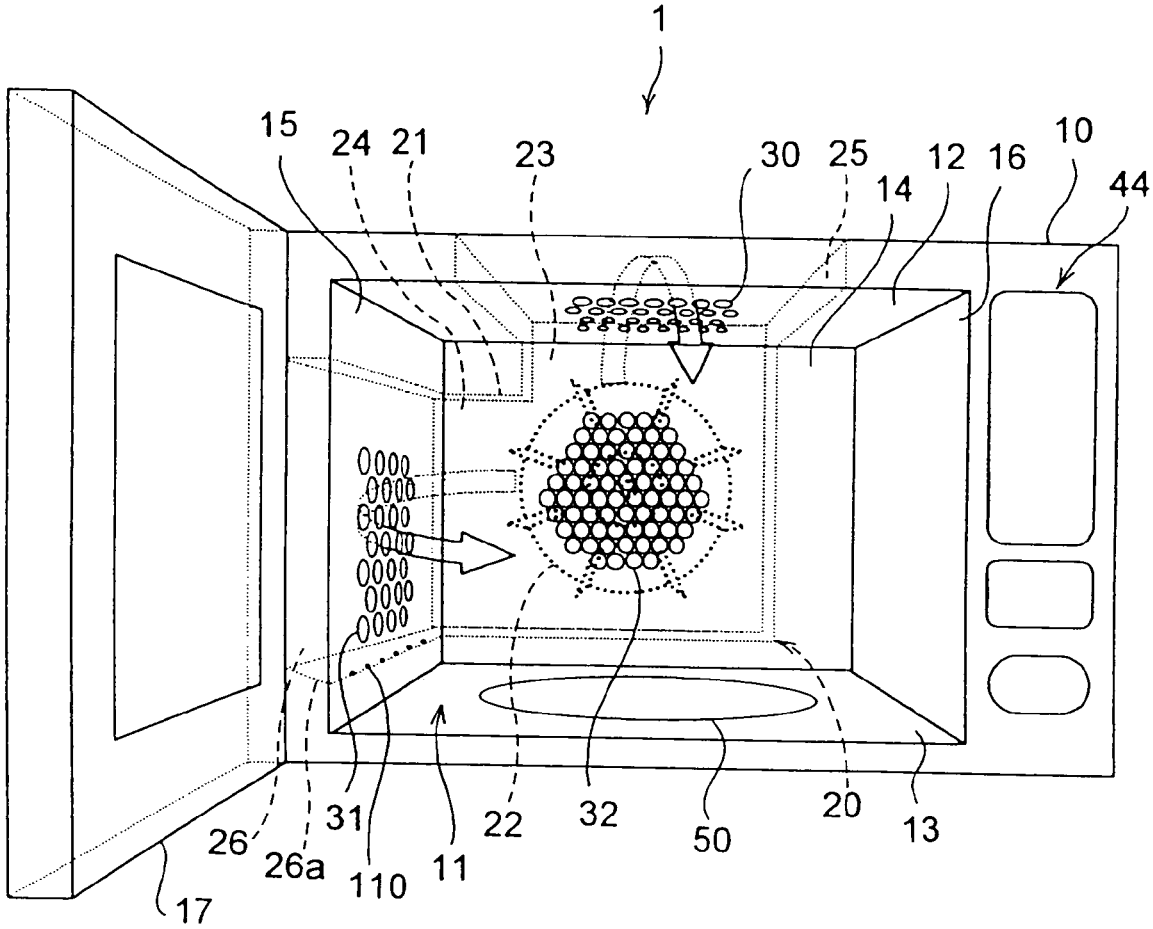
FIG. 29 is a front view showing an eighteenth embodiment of a cooking oven according to the invention, showing it in perspective.
Figure 30:
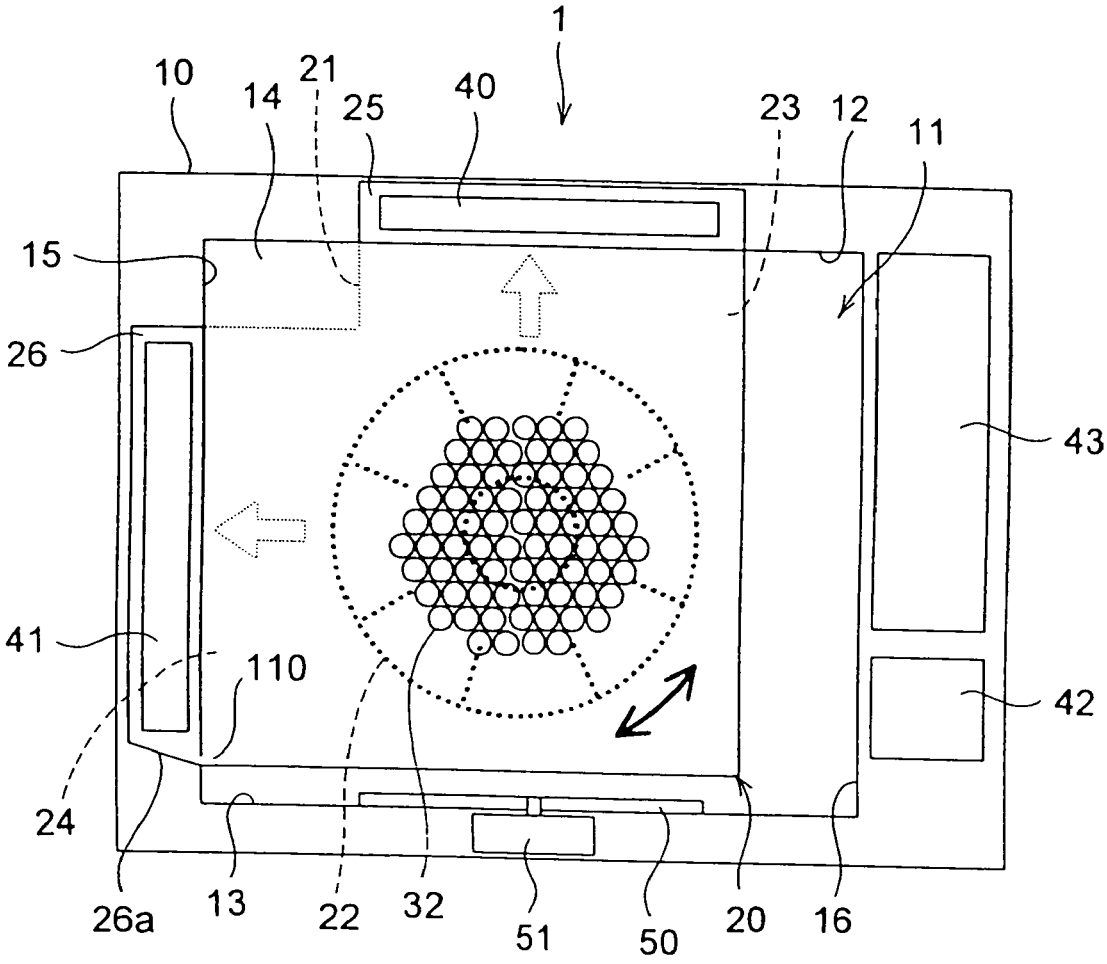
FIG. 30 is a vertical sectional view of the cooking oven of the eighteenth embodiment.

FIGS. 29 and 30 show an eighteenth embodiment of the cooking oven 1. In the eighteenth embodiment, a modification is made in the structure of the side duct 26. This embodiment can be implemented on the basis of any of the embodiments already described.

Through the side duct 26 flow oily fumes containing oil, fat, odor substances, and the like released from foods 60. Some kinds of food 60 release a large amount of oily fumes. When an extremely large amount of oily fumes is released, the oil that has not been decomposed by the catalyst soils the interior surfaces of the side duct 26, and collects at the bottom thereof. Also as the cooking oven 1 is used for a long period, oil gradually collects.

To overcome these inconveniences, the floor surface 26*a* of the side duct 26 is so slanted as to sink toward the cooking chamber 11. In the left inner wall 15 of the cooking chamber 11, a plurality of oil drain holes 110 that lead to the lowest part of the floor surface 26 are formed at predetermined intervals along the depth direction of the side duct 26.

In this construction, oil that has flown down to the bottom of the side duct 26 flows along the slanted floor surface 26*a*, and then flows through the oil drain holes 110 into the cooking chamber 11. The oil that has flown into the cooking chamber 11 can be easily wiped off and thereby disposed of. This prevents oil from remaining on the catalyst paint surface inside the side duct 26, and thus helps maintain the effect of the catalyst paint without deterioration.

Figure 31:
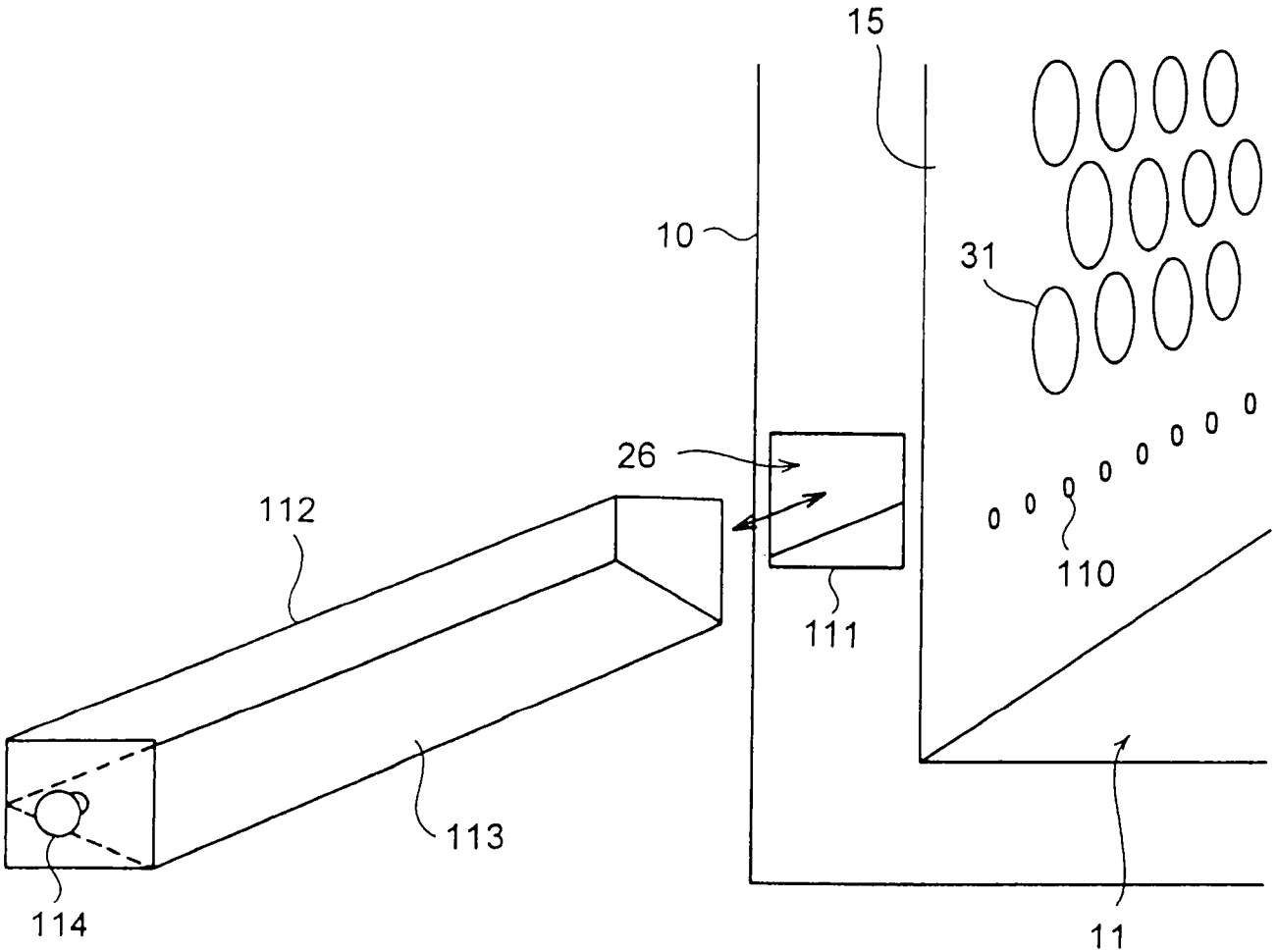
FIG. 31 is a perspective view of a principal portion of a nineteenth embodiment of a cooking oven according to the invention.

FIG. 31 shows a nineteenth embodiment of the cooking oven 1. The nineteenth embodiment is a modified version of the eighteenth embodiment. In this embodiment, in the front face of the cooking oven 1, there is formed a rectangular opening 111 that leads to the bottom of the side duct 26. Through this opening 111, a drawer-type drain pan 112 is inserted into the side duct 26. The drain pan 112 is open toward the cooking chamber 11, and has the floor surface 113 thereof slanted so as to sink toward the cooking chamber 11. In the left inner wall 15 of the cooking chamber 11, a plurality of oil drain holes 110 that lead to the lowest part of the floor surface 113 are formed at predetermined intervals along the depth direction of the side duct 26.

In this construction, oil that has flown down to the bottom of the side duct 26 flows along the slanted floor surface 113 of the drain pan 112, and then flows through the oil drain holes 110 into the cooking chamber 11. The oil that has flown into the cooking chamber 11 can be easily wiped off and thereby disposed of. This prevents oil from remaining on the catalyst paint surface inside the side duct 26, and thus helps maintain the effect of the catalyst paint without deterioration.

When the drain pan 112 becomes soiled, it is drawn out by pulling a knob 114 fitted to the front face thereof. The drain pan 112 is cleaned with detergent or the like, and is then put back into the bottom of the side duct 26.

Figure 32:
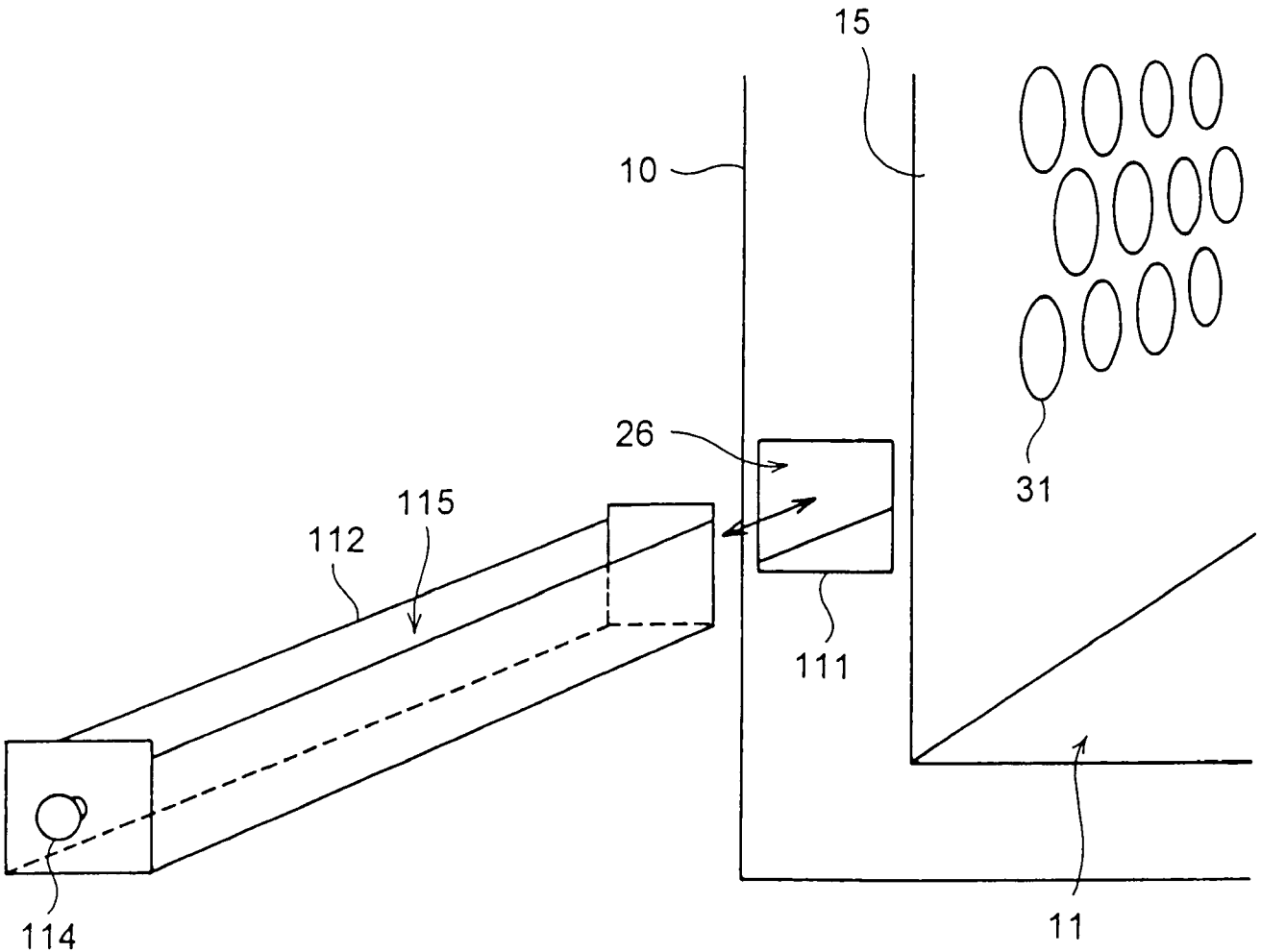
FIG. 32 is a perspective view of a principal portion of a twelfth embodiment of a cooking oven according to the invention.

FIG. 32 shows a twentieth embodiment of the cooking oven 1. In the twentieth embodiment, a modification is made in the drain pan 112 of the nineteenth embodiment. Specifically, in the drain pan 112 of the twentieth embodiment, oil collects in a gutter-shaped oil collection portion 115. Accordingly, no oil drain holes are formed in the left inner wall 15 of the cooking chamber 11. When oil collects in the oil collection portion 115, the drain pan 112 is drawn out by pulling a knob 114 fitted to the front face thereof, and the oil is disposed of. The drain pan 112 is cleaned with detergent or the like, and is then put back into the bottom of the side duct 26.

Advisably, the interior shape of the side duct 26 and the shape of the catalyst paint surface are so devised as to permit easy collection of oil in the drain pan 112. This applies also to the nineteenth embodiment.

A mechanism for oil disposal as described above may be provided also for the upper duct 25. To permit oil to flow into the cooking chamber 11, the floor surface of the upper duct 25 is slanted as follows. It is so slanted as to one-sidedly sink toward one of the rear inner wall 14, left inner wall 15, and right inner wall 16; alternatively, like a gable roof, it is so slanted as to two-sidedly sink toward both the left inner wall 15 and right inner wall 16; or alternatively, like a hipped roof, it is so slanted as to three-sidedly sink toward the rear inner wall 14, left inner wall 15, and right inner wall 16. In any case, oil drain holes are formed as close as possible to the rear inner wall 14, left inner wall 15, and right inner wall 16 so that oil does not drip onto foods 60. Consideration needs to be taken also to prevent entry of oil into the blower 20.

A drain pan like the drain pan 112 used in the nineteenth and twentieth embodiments may be provided for the upper duct 25.

In a case where a drain pan is provided for the upper duct 25 or side duct 26, the position in which to arrange the drain pan, the shape and fitting arrangement of the door 17 should advisably be so designed that the drain pan can be drawn out when the door 17 is open.

The embodiments described hereinbefore all deal with cases in which catalyst paint is applied to an interior wall surface of a duct through which a hot air stream for heating foods is passed, i.e., a duct that forms a principal circulation passage. It is, however, also possible to provide a subsidiary circulation passage through which the air inside a cooking chamber is circulated for the purpose of decomposing oil fumes and odor substances rather than for the purpose of heating foods, and apply catalyst paint to an interior wall surface of a duct that forms the subsidiary circulation path.

A catalyst block does not necessarily have to be used in combination with catalyst paint. That is, it is also possible to rely solely on catalyst paint.

It should be understood that the embodiments of the present invention described hereinbefore are merely examples of constructions according to the invention, and are not meant to limit the scope of the invention in any way; that is, many further modifications and variations are possible in carrying out the invention within the concept of the invention.

INDUSTRIAL APPLICABILITY

As described above, according to the present invention, in a cooking oven wherein a catalyst is made to act upon a hot air stream circulated inside a cooking chamber in order to decompose oily fumes and odor substances, it is possible to efficiently heat the catalyst to make it function satisfactorily. Moreover, it is possible to arrange the catalyst easily. Furthermore, in arranging a heater inside a duct through which a air stream is sent to the cooking chamber, it is possible to improve the air heating efficiency of the heater. With these features, it is possible to enhance the cooking performance of professional-use and household-use cooking ovens.

The invention claimed is:

1. A cooking oven having a blowout port and a suction port for passage of a hot air stream provided inside a cooking chamber and having a blower and a heat source for producing the hot air stream provided outside the cooking chamber so as to produce a circulated hot air stream inside the cooking chamber so that foods are cooked with heat by the circulated air stream, wherein a catalyst block for decomposing a substance released from the foods and a heat source for heating the catalyst block are arranged inside a duct through which the hot air stream is fed to the blowout part, the heat source is so arranged as to face a plurality of faces of the catalyst block, and of the plurality of faces of the catalyst block, one is a face that faces in a direction from which the circulated air stream blows and another is a face opposite thereto.

2. The cooking oven according to claim 1, wherein the catalyst block is held by a fitting member in such a way as not to make contact with an interior wall surface of the duct.

3. The cooking. oven according to claim 2, wherein the fitting member is fitted to a lid of a catalyst replacement opening formed in the duct.

4. A cooking oven having a blowout port and a suction port for passage of a hot air stream provided inside a cooking chamber and having a blower and a heat source for producing the hot air stream provided outside the cooking chamber so as to produce a circulated hot air stream inside the cooking chamber so that foods are cooked with heat by the circulated air stream, wherein catalyst paint for decomposing a substance released from the foods is applied to at least part of an interior wall surface of a duct through which the hot air stream is fed to the blowout port; and a catalyst block for decomposing a substance released from the foods is provided adjacent the heat source for heating the catalyst block, the heat source comprising first and second heaters on opposite sides of the catalyst block so as to sandwich the catalyst block therebetween.

5. The cooking oven according to claim 4, wherein the surface to which the catalyst paint is applied has surface irregularities.

6. The cooking oven according to claim 5, wherein wave-shaped surface irregularities are formed on the interior wall surface of the duct in such a way that, of slanted surfaces forming the surface irregularities, those facing in a direction from which the air stream blows are long and those facing in a direction opposite thereto are short.

7. The cooking oven according to claim 5, wherein the surface irregularities are formed as ridges or grooves aligned along the air stream.

8. The cooking oven according to claim 4, wherein the catalyst paint is applied to a air stream-regulating plate provided inside the duct for regulating the air stream flowing toward the blowout port.

9. A cooking oven having a blowout port and a suction port for passage of a hot air stream provided inside a cooking chamber and having a blower and a heat source for producing the hot air stream provided outside the cooking chamber so as to produce a circulated hot air stream inside the cooking chamber so that foods are cooked with heat by the circulated air stream, wherein a catalyst block for decomposing a substance released from the foods and a heat source for heating the catalyst block are arranged inside a duct through which the hot air stream is fed to the blowout port, the heat source comprising first and second heaters on opposite sides of the catalyst block so as to sandwich the catalyst block therebetween, the catalyst block is fitted at a distance from an interior wall surface of the duct, and catalyst paint for decomposing a substance released from the foods is applied to at least part of an interior wall surface of the duct.

10. The cooking oven according to claim 9, wherein the surface to which the catalyst paint is applied has surface irregularities.

11. The cooking oven according to claim 10, wherein wave-shaped surface irregularities are formed on the interior wall surface of the duct in such a way that, of slanted surfaces forming the surface irregularities, those facing in a direction from which the air stream blows are long and those facing in a direction opposite thereto are short.

12. The cooking oven according to claim 10, wherein the surface irregularities are formed as ridges or grooves aligned along the air stream.

13. The cooking oven according to claim 9, wherein the catalyst paint is applied to a air stream-regulating plate provided inside the duct for regulating the air stream flowing toward the blowout port.

14. A cooking oven having a blowout port and a suction port for passage of a hot air stream provided in a wall of a cooking chamber and having a blower and a duct provided outside the cooking chamber, the blower sucking in air through the suction port and the duct directing air blown out from the blower to the blowout port and heating the air with a heater incorporated therein, so as to produce a circulated hot air stream inside the cooking chamber so that foods are cooked with heat by the circulated air stream, wherein a catalyst block for decomposing a substance released from the foods is arranged inside the duct, and distribution of amount of heat generated by the heater within a cross section of the duct is so set as to be commensurate with distribution of amount of air stream within that cross section so that an increasingly large amount of heat is generated as there is an increasingly large amount of air stream.

15. The cooking oven according to claim 14, wherein the catalyst block is so arranged as to lie lopsided toward a side of a cross section of the duct where the amount of heat generated by the heater is larger.

16. The cooking oven according to claim 15, wherein the catalyst block is fitted to an interior wall of the duct at a side thereof where the amount of heat generated by the heater is larger.

17. The cooking oven according to claim 14, wherein the duct has a bent portion at a midpoint thereof, the heater is arranged at or on a downstream side of the bent portion, and distribution of the amount of heat gelnerated by the heater is so set that an increasingly large amount of heat is generated from an inner side to an outer side of the bent portion.

18. The cooking oven according to claim 17, wherein the catalyst block is so arranged as to lie lopsided toward a side of a cross section of the duct where the amount of beat generated by the heater is larger.

19. The cooking oven according to claim 18, wherein the catalyst block is fitted to an interior wall of the duct at a side thereof where the amount of heat generated by the heater is larger.

* * * * *